US008016573B2

(12) United States Patent
Kitahara et al.

(10) Patent No.: US 8,016,573 B2
(45) Date of Patent: Sep. 13, 2011

(54) PIEZOELECTRIC-DRIVEN DIAPHRAGM PUMP

(75) Inventors: Harunori Kitahara, Hirakata (JP); Tsukasa Hojo, Hirakata (JP)

(73) Assignee: Panasonic Electric Works Co. Ltd., Osaka (JP)

( * ) Notice: Subject to any disclaimer, the term of this patent is extended or adjusted under 35 U.S.C. 154(b) by 645 days.

(21) Appl. No.: 11/722,919

(22) PCT Filed: Jan. 25, 2006

(86) PCT No.: PCT/JP2006/301896

§ 371 (c)(1),
(2), (4) Date: Jun. 27, 2007

(87) PCT Pub. No.: WO2006/080566

PCT Pub. Date: Aug. 3, 2006

(65) Prior Publication Data

US 2009/0232680 A1 Sep. 17, 2009

(30) Foreign Application Priority Data

Jan. 26, 2005 (JP) ..... 2005-018967
Apr. 25, 2005 (JP) ..... 2005-127038

(51) Int. Cl.
*F04B 17/00* (2006.01)

(52) U.S. Cl. ..... 417/413.1; 417/413.2; 310/324; 310/328

(58) Field of Classification Search ..... 417/413.1, 417/413.2, 412, 410.1; 310/323.01, 323.02, 310/324, 328
See application file for complete search history.

(56) References Cited

U.S. PATENT DOCUMENTS 3,496,872 A * 2/1970 Riester et al. ..... 92/94
5,205,819 A * 4/1993 Ross et al. ..... 604/67
5,433,351 A 7/1995 Okuyama et al.
5,649,809 A * 7/1997 Stapelfeldt ..... 417/63
6,033,191 A * 3/2000 Kamper et al. ..... 417/322
(Continued)

FOREIGN PATENT DOCUMENTS

EP 1277957 1/2003
(Continued)

OTHER PUBLICATIONS

English language Abstract of JP 3-1876, Jan. 8, 1991.
(Continued)

*Primary Examiner* — Charles G Freay
*Assistant Examiner* — Todd D Jacobs
(74) *Attorney, Agent, or Firm* — Greenblum & Bernstein P.L.C.

(57) ABSTRACT

A piezoelectric-driven diaphragm pump is comprised of a driving unit (1) having a driving diaphragm (12) and a first housing (11), a replaceable driven unit (2) having a driven film (241) and a second housing (21), and a fixing unit (3) for fixing the driven unit (2) to the driving unit (1). A vibration transmitting face (14) of the driving diaphragm (12) from which displacement of the driving diaphragm (12) is transmitted to the driven film (241) and a vibration transmitted face (241*a*) of the driven film (241) to which the displacement of the driving diaphragm is transmitted are not parallel to a reference plane (11*b*) of the first housing (11) which faces the second housing (21), and the vibration transmitting face (14*b*) of the driving diaphragm (12) contacts with entire of the vibration transmitted face (241*a*) of the driven film (241). Thereby, the displacement of the driving diaphragm (12) is efficiently transmitted to the driven film (241), so that a capacity of a pump room (25) can be varied largely.

7 Claims, 20 Drawing Sheets

U.S. PATENT DOCUMENTS

| | | | | |
|---|---|---|---|---|
| 6,755,626 | B2 | 6/2004 | Komatsu et al. | |
| 6,960,864 | B2 | 11/2005 | Urano et al. | |
| 7,066,086 | B1 * | 6/2006 | Endo et al. | 101/114 |

FOREIGN PATENT DOCUMENTS

| | | | |
|---|---|---|---|
| EP | 1323925 | | 7/2003 |
| JP | 1-285681 | | 11/1989 |
| JP | 2-69079 | | 5/1990 |
| JP | 3-1876 | | 1/1991 |
| JP | 6-024492 | | 2/1994 |
| JP | 2004-340097 | | 12/2004 |
| JP | 2004-353493 | | 12/2004 |
| JP | 2004353493 | A * | 12/2004 |
| JP | 2005307858 | A * | 11/2005 |

OTHER PUBLICATIONS

English language Abstract of JP 2004-340097, Dec. 2, 2004.
English language Abstract of JP 2004-353493, Dec. 16, 2004.
English language Abstract of JP 1-285681, Nov. 16, 1989.
English language partial translation of JP 2-69079 U, May 25, 1990.
English language Abstract of JP 6-024492, Jan. 2, 1994.

* cited by examiner

PRIOR ART

PIEZOELECTRIC-DRIVEN DIAPHRAGM PUMP

TECHNICAL FIELD

The present invention relates to a piezoelectric-driven diaphragm pump in which a piezoelectric element is used as an actuator.

BACKGROUND ART

In a piezoelectric-driven diaphragm pump in which a piezoelectric element is used as an actuator, a diaphragm is driven by the piezoelectric element, and a capacity of a pump room is varied corresponding to the displacement of the diaphragm. When the capacity of the pump room is increased, a discharge valve is closed and a suction valve is opened so that a fluid is sucked into the pump room. Alternatively, when the capacity of the pump room is decreased, the suction valve is closed and the discharge valve is opened so that the fluid is discharged from the pump room. The diaphragm is driven by expansion and contraction of the piezoelectric element when an alternating voltage is applied between electrodes of the piezoelectric element. In such piezoelectric-driven diaphragm pump, a minute transformation of the piezoelectric element in a radial direction can be transformed to a large displacement in a thickness direction, so that the piezoelectric element can be driven by a low voltage. A power generated by the diaphragm, however, becomes lower because of using such a displacement enlarging mechanism.

On the other hand, a pump which discharges a fluid generally has a problem of internal contamination with the fluid. For example, when a fluid such as alcohol including solid matter is stayed in the pump, each component of the fluid or inclusion adheres on or dissolves the elements of the pump such as valves or pipes. As a result, the valves may be deteriorated so that the valves cannot be opened and closed normally. A life time of the pump may be shortened.

A method for solving the shortening of the file time of the pump, it is proposed to replace a portion of the pump where the fluid flows. Japanese Laid-Open Patent Publication No. 1-285681 discloses a conventional pump that a driving unit having a piezoelectric element and a valve unit having an inlet with a suction valve and an outlet with a discharge valve are detachably divided. When contamination or deterioration of the valves due to the fluid occurs, the valve unit can be replaced. The driving unit and the valve unit are coupled by screw-in fitting, and a tubular is fluid-tightly sealed by an elastic film. Although the elastic film must be compressed to a support member of a bimorph, when the elastic film is compressed to the support member with a strong force, it disturbs vibration of the bimorph.

Official Gazette of Japanese Utility Model Registration No. 2542620 discloses another conventional pump comprised of an actuator unit and a pump unit detachably coupled to the actuator unit, thereby only the pump unit can be replaced. Since the actuator unit and the pump unit are coupled by a double-sided adhesive tape or a hook and loop fastener, a piezoelectric diaphragm may be damaged at the replacement of the pump unit.

Japanese Laid-Open Patent Publication No. 6-24492 discloses still another conventional pump that a driving object having a piezoelectric element as an actuator is detachable from a main pump unit, and the driving object applied a displacement to a side wall of the main pump unit made of a flexible material. However, the displacement of the piezoelectric element in a direction perpendicular to the side wall is smaller, and the displacement transmitted member has a flat shape, so that the transmission efficiency of the displacement of the piezoelectric element is lower. Further more, it needs a coupling member such as a double-sided adhesive tape for coupling the driving object to the main pump unit.

Japanese Laid-Open Patent Publication No. 2004-353493 discloses still another conventional pump that a space between a driving diaphragm and a driven diaphragm is sealed, and vibration of the driving diaphragm is transmitted to the driven diaphragm by a transmission medium filled in the sealed space.

FIG. 28 shows the conventional piezoelectric-driven diaphragm pump disclosed in Japanese Laid-Open Patent Publication No. 2004-353493. The conventional piezoelectric-driven diaphragm pump 200 is comprised of a driving unit having 201*a* driving diaphragm 203 driven by a piezoelectric element 202, a replaceable driven unit 204 and a fixing unit 209 for fixing the driven unit 204 to the driving unit 201. A transmission medium 210 such as a liquid is filled in a sealed space 211 between the driving diaphragm 203 of the driving unit 201 and a driven diaphragm (driven film) 205 of the driven unit 204 so as to transmit the vibration efficiently. Thereby, the vibration of the driving diaphragm 203 can be transmitted to the driven diaphragm 205 via the transmission medium 210, and thereby, the driven unit 204 can perform a pump motion. Specifically, alternative of the valves 207 is opened and the rest is closed by variation of a capacity of a pump room 206 of the driven unit 204, so that a fluid in the pipe 208 is sucked into the pump room 206 and a fluid in the pump room 206 is discharged to the pipe 208.

In the conventional piezoelectric-driven diaphragm pump 200, the driven diaphragm 205 is formed in a flat plate shape, and the driven diaphragm 205 is not contact with any portion of the driving diaphragm 203. When the driving diaphragm 203 is displaced so as to reduce a capacity of the sealed space 211, the driving diaphragm 203 presses the transmission medium 210 and the pressed transmission medium 210 further pressed the driven diaphragm 205. Thereby, the driven diaphragm 205 is driven for decreasing the capacity of the pump room 206. Alternatively, when the driving diaphragm 203 is displaced so as to reduce a capacity of the sealed space 211, a pressure of the transmission medium 210 is reduced so that a negative pressure occurs in the sealed space 211. Thereby, the driven diaphragm 205 is driven for increasing the capacity of the pump room 206.

The above-mentioned conventional piezoelectric-driven diaphragm pump 200 has a problem that a volume of the transmission medium 210 is varied corresponding to the pressure, so that the vibration of the driving diaphragm 203 cannot be transmitted to the driven diaphragm 205 directly. Especially, when a frequency of the vibration of the driving diaphragm 203 is lower, following performance of the driven member 205 is splendid. However, when the frequency of the vibration of the driving diaphragm 203 becomes higher, the following performance of the driven member 205 is lowered.

Furthermore, when the driven unit 204 is replaced, it is difficult to fill the transmission medium all 210 such as a liquid into the sealed space 211 without containing air chambers. If the air chambers are contained in the transmission medium 210, transmission efficiency of the transmission medium 210 for transmitting the vibration of the driving diaphragm 203 to the driven diaphragm 205 may be lowered.

DISCLOSURE OF INVENTION

The present invention is conceived to solve the above problems, and to provide a piezoelectric-driven diaphragm pump having a simple configuration without using any transmission medium such as a liquid, capable of transmitting vibration of a driving diaphragm to a driven film directly, and having high transmission efficiency and following performance to high-speed vibration even when a driven unit is replaced.

A piezoelectric-driven diaphragm pump in accordance with an aspect of the present invention comprises: a driving unit configured by a driving diaphragm having a piezoelectric element and a diaphragm sheet which is elastically transformed corresponding to transformation of the piezoelectric element, and a first housing for holding the driving diaphragm capable of vibration; a driven unit driven by the driving unit and having a driven film to which vibration of the driving diaphragm is transmitted, a second housing for holding the driven film, valves performing open and close motions for sucking and discharging fluid into and from a cavity formed between the second housing and the driven film, and pipe conduits through which the fluid passes; and a fixing unit for detachably fixing the driven unit to the driving unit.

At least one of a vibration transmitting face of the driving diaphragm from which displacement of the driving diaphragm is transmitted to the driven film and a vibration transmitted face of the driven film to which the displacement of the driving diaphragm is transmitted is not parallel to a reference plane of the first housing which faces the second housing, and the vibration transmitting face of the driving diaphragm contacts with at least a part of the vibration transmitted face of the driven film.

By such a configuration, the vibration transmitting face of the driving diaphragm can be contacted with the vibration transmitted face of the driven film closely without intervening air between them. Therefore, the vibration of the driving diaphragm can be transmitted to the driven member efficiently so that the piezoelectric-driven diaphragm pump can be driven smoothly. Furthermore, since no transmission medium such as a liquid is used, the driven unit can easily be replaced by a user who has no special technique. Still furthermore, the transmission efficiency of the vibration of the driving diaphragm to the driven member and the following performance of the driven member to high-speed vibration of the driving diaphragm are rarely lowered, even when the driven unit is replaced in the user side.

BEST MODE FOR CARRYING OUT THE INVENTION

First Embodiment

Figure 1:
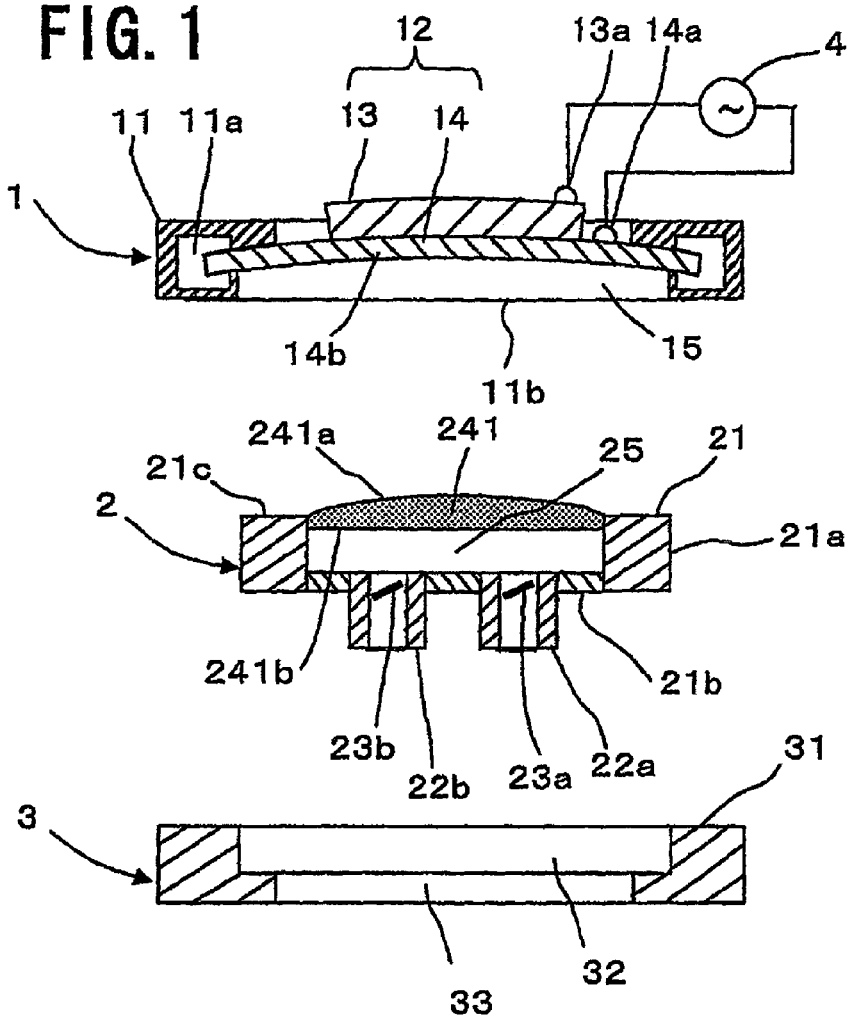
FIG. 1 is an exploded sectional view showing a configuration of a piezoelectric-driven diaphragm pump in accordance with a first embodiment of the present invention.
Figure 2:
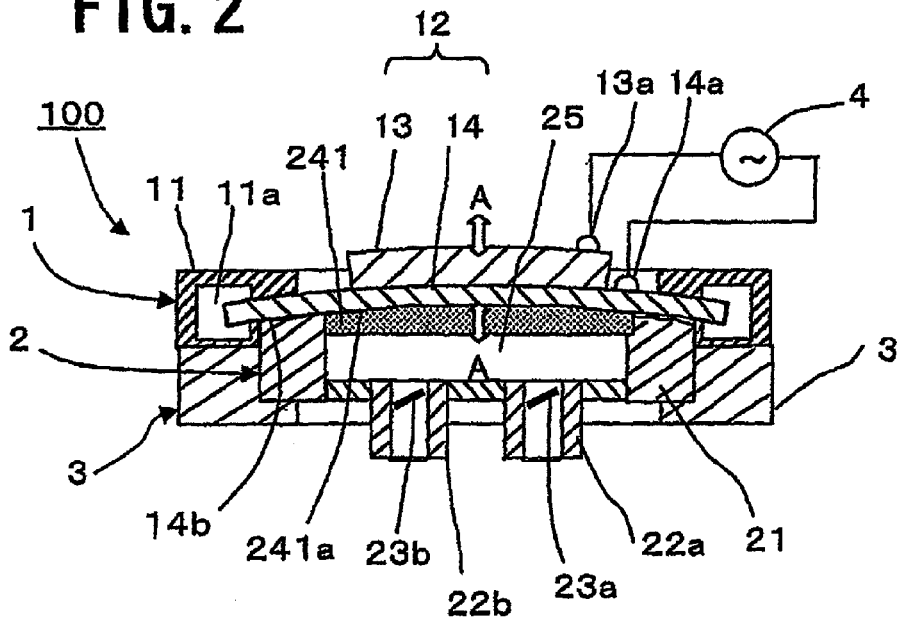
FIG. 2 is a sectional view showing a configuration of the above piezoelectric-driven diaphragm pump in the first embodiment after completing assembly thereof.

A piezoelectric-driven diaphragm pump in accordance with a first embodiment of the present invention is described with reference to the figures. FIG. 1 shows a condition where a piezoelectric-driven diaphragm pump P in accordance with the first embodiment is discomposed into each unit. FIG. 2 shows the piezoelectric-driven diaphragm pump P which is an assembly of the units shown in FIG. 1. As shown in FIGS. 1 and 2, the piezoelectric-driven diaphragm pump P is comprised of a driving unit 1 having a function of an actuator, a driven unit 2 driven by a driving force of the driving unit 1, and a fixing unit 3 for detachably fixing the driven unit 2 on the driving unit 1.

The driving unit 1 has a first housing 11 and a driving diaphragm 12. The driving diaphragm 12 is fixed on the first housing 11. The first housing 11 has a first fitting portion 15 in a center thereof, and an upper portion of exchangeable driven unit 2 is inserted into the first fitting portion 15 of the first housing 11. The driving diaphragm 12 is constituted by a piezoelectric element 13 (PZT) and a diaphragm sheet 14 which is made of a conductive member and elastically transformable corresponding to transformation of the piezoelectric element 13.

For example, each of the piezoelectric element 13 and the diaphragm sheet 14 is formed as a circle-shaped flat plate, and the piezoelectric element 13 is concentrically adhered at the center on a face of the diaphragm sheet 14. In addition, a portion in the vicinity of circumference of the diaphragm sheet 14 is closely fixed on the first housing 11. As an example of the dimensions of the piezoelectric element 13 and the diaphragm sheet 14, a diameter of the piezoelectric element 13 is 15 mm and a thickness thereof is 0.20 mm, and a diameter of the diaphragm sheet 14 is 20 mm and a thickness thereof is 0.20 mm.

Electrodes 13*a* and 14*a* are respectively formed on the piezoelectric element 13 and the diaphragm sheet 14. The piezoelectric element 13 is transformed by applying a voltage between the electrodes 13*a* and 14*a* by a voltage control unit 4. The diaphragm sheet 14 is further elastically transformed depending on the transformation of the piezoelectric element 13, and thereby, suction and discharge of the piezoelectric-driven diaphragm pump P are controlled. The voltage applied to the piezoelectric element 13 is, for example, an alternating voltage between +120V and 0V. It is assumed that the pump performs discharge motion when a voltage of +120V is applied, and performs suction motion when a voltage of 0V is applied.

Such driving diaphragm 12 is formed by gluing the diaphragm sheet 14 of a metal plate and the piezoelectric element 13 together in a high-temperature. Therefore, the driving diaphragm 12 bends at ordinary temperature by difference between thermal expansions of the piezoelectric element 13 and the diaphragm sheet 14. In the first embodiment, the bend of the driving diaphragm 12 is the convex that is curved on the top, as shown in FIGS. 1 and 2. In an initial state where no voltage is applied to the piezoelectric element 13, the diaphragm sheet 14 is fixed on the first housing 11 in a manner so that it is inwardly concaved into the first housing 11, in other words, the diaphragm sheet 14 is formed with a concavity with respect to a reference plane 11*b* when a face (bottom face) of the first housing 11 that faces a second housing 21 described later is referred as a reference plane.

The first housing 11 is a resin formed object made of a plastic (for example, polyacetal (POM), poly carbonate (PC), poly phenyl styrene (PPS)) molded as a cylindrical shape, and the first fitting portion 15 is a cylindricality cavity. Furthermore, a hollow portion 11*a* is formed between an inner wall and an outer wall of the first housing 11. The circumference portion of the diaphragm sheet 14 is inserted into and closely adhered on the hollow portion 11*a*, so that the diaphragm sheet 14 is fixed on the first housing 11. Thereby, the driving diaphragm 12 is fixed on the first housing 11.

The driven unit 2 is comprised of the second housing 21 which is, for example, made of the above-mentioned plastic and has a ring shaped side wall 21*a* and a bottom wall 21*b*, and a driven film 241 that a circumference portion thereof is adhered and fixed on a top face 21*c* of the side wall 21*a* of the second housing 21. The driven film 241 serves as a driven diaphragm. A pump room 25 is formed by the second housing 21 and the driven film 241. A suction pipe 22*a*, through which a fluid to be sucked into the pump room 25 flows, and a discharge pipe 22*b*, through which a fluid to be discharged outside from the pump room 25 flows, are respectively connected to the bottom face 26 of the second housing 21. Furthermore, a suction-valve 23*a* and a discharge valve 23*b*, which respectively work the suction motion and the discharge motion of the fluid, are further provided in the suction pipe 22*a* and the discharge pipe 22*b*. An outside diameter of the second housing 21 is substantially equal to an inside diameter of the first fitting portion 15 of the first housing 11 of the above driving unit 1. Thus, the second housing 21 of the driven unit 2 can be fitted to the first fitting portion 15 of the first housing 11 of the driving unit 1 from the bottom face.

A planar shape of the driven film 241 is substantially a circle, and a cross-sectional shape thereof in a thickness direction is formed so that an outside face 241*a* facing the driving diaphragm 12 is convex formed of a single curve protruding toward the driving diaphragm 12 having a vertex at the center of the circle and an inside face 241*b* at the pump room 25 side is planar. The driven film 241 is made of, for example, a material having high chemical resistance such as hydrogenation nitril butadiene rubber (hereinafter, it is abbreviated as HNBR).

When it is started to fit the second housing 21 of the driven unit 2 to the first fitting portion 15 of the first housing 11 of the driving unit 1, the outside face 241*a* of the driven film 241 starts to contact to an outside face 14*b* of the diaphragm sheet 14 facing the driven film 241 from the center portion. When the second housing 21 of the driven unit 2 is completely fitted to the first fitting portion 15 of the first housing 11, the outside face 241*a* of the driven film 241 contacts entire of the outside face 14*b* of the diaphragm sheet 14, closely. In the first embodiment, the outside face 14*b* of the diaphragm sheet 14 serves as a vibration transmitting face that transmits displacement of the driving diaphragm 12 to the driven film 241, and the outside face 241*a* of the driven film 241 serves as a vibration transmitted face to which the displacement of the driving diaphragm 12 is transmitted. In addition, the vibration transmitting face of the driving diaphragm 12 (that is, the outside face 14*b* of the diaphragm sheet 14) is the concavity with respect to the reference plane 11*b* of the first housing 11, and the vibration transmitted face of driven film 241 (that is, the outside face 241*a* of the driven film 241) is the convexity with respect to the reference plane 11*b*. (The same goes for second to eighth embodiments which will be described later.)

The driven film 241 may be directly fixed to the second housing 21 of the driven unit 2 by adhesion or welding. Alternatively, it is possible to form protrusions on either of the circumference portion of the driven film 241 and the top face 21*c* of the side wall 21 of the second housing 21, and to form cuttings with which the protrusions are engaged on the other, and thereby, the driven film 241 may be fixed on the second housing 21 by the engagement of the protrusions and the cuttings. Alternatively, it is possible to provide an additional fixing member which is fixed on the top face 21*c* of the side wall 21*a* of the second housing 21, and to interleave the driven film 241 between the top face 21*c* of the side wall 21*a* of the second housing 21 and the fixing member so as to fix the driven film 241 on the second housing 21.

The fixing unit 3 is comprised of a third housing 31 molded of a plastic for holding the driven unit 2 with the first housing 11 of driving unit 1 (other members are not illustrated). The third housing 31 of the fixing unit 3 is formed as a toric shape having substantially the same outside diameter as that of the first housing 11 of the driving unit 1. A second fitting portion 32, which has the same inside diameter as that of the first fitting portion 15 of the driving unit 1 and to which a lower portion of the driven unit 2 is fitted, is formed at the center of the third housing 31. Furthermore, a through hole 33, through which the suction pipe 22*a* and the discharge pipe 22*b* of the driven unit 22 penetrate, is formed on the center of a bottom face of the second fitting portion 32. When the lower portion of the driven unit 2 is fitted to the fixing unit 3, the suction pipe 22*a* and the discharge pipe 22*b* of the driven unit 22 penetrate through the through hole 33 and protrude outward, so that they can be connected with other pipe arrangement.

In assembly of the driving unit 1, the driven unit 2 and the fixing unit 3, the lower portion of the second housing 21 of the driven unit 2 is fitted to the second fitting portion 32 of the third housing 31 of the fixing unit 3, first. Subsequently, the upper portion of the second housing 21 of the driven unit 2 is further fitted to the first fitting portion 15 of the first housing 11 of the driving unit 11. Then, the bottom face of the first housing 11 of the driving unit 1 and the top face of the third housing 31 of the fixing unit 3 are contacted with each other, and the first housing 11 and the third housing 31 are fixed while a condition that the driven unit 2 is contained and held in between the driving unit 1 and the fixing unit 3 is maintained. For fixing first housing 11 and the third housing 31, various methods such as screw cramp, engagement of a hook and a recess, and so on can be considered. Hereupon, the illustration of the fixing structure of the first housing 11 and the third housing 31 is omitted.

When the driving unit 1 and the fixing unit 3 are fixed with the condition that the driven unit 2 is held in between the driving unit 1 and the fixing unit 3, the driven film 241, which is adhered on the top face 21*c* of the second housing 21 of the driven unit 2, is pressed to and closely put to the outside face 14*b* of the diaphragm sheet 14 of the driving diaphragm 12. At this time, since the outside face 241*a* of the driven film 241 has the convexity having a vertex at the center thereof, the center portion of the outside face 241*a* of the driven film 241 contacts the center portion of the outside face 14*b* of the diaphragm sheet 14, first. Following to the insertion of the driven unit 2 into the first fitting portion 15 of the driving unit 1, contact area of the outside face 241*a* of the driven film 241 and the outside face 14*b* of the diaphragm sheet 14 gradually increases. As this contact area spreads, air existed in the first fitting portion 15 of the first housing 11 of the driving unit 1 is pushed out to outside of the first fitting portion 15 through a minute clearance between the first fitting portion 15 and the second housing 21. When the fitting of the driving unit 1 and the driven unit 2 is completed, the driving diaphragm 12 and the driven film 241 are unified by entirely and closely contacting with each other including no air in between them.

For driving the piezoelectric-driven diaphragm pump P assembled as above, an alternating voltage (varied from +120V to 0V) is applied to the piezoelectric element 13 of the driving diaphragm 12 from the voltage control unit 4. In the initial state where no voltage is applied to the piezoelectric element 13, the diaphragm sheet 14 is fixed on the first housing 11 in a manner so that the outside face 14*b* becomes concavity with respect to the reference plane 11*b*. When a positive voltage is applied to the piezoelectric element 13, the piezoelectric element 13 contracts in a radial direction thereof but the diaphragm sheet 14 cannot contract, so that the bending quantity of the diaphragm sheet 14 decreases corresponding to the transformation of the piezoelectric element 13. When the voltage of the piezoelectric element 13 is turned back to the grounding voltage, the diaphragm sheet 14 turns to the shape in the initial state by own resilience of the diaphragm sheet 14.

In this way, the piezoelectric element 13 expands and contracts in the radial direction by the alternating voltage applied from the voltage control unit 4, and the diaphragm sheet 14 is vibrated by such expansion and contraction of the piezoelectric element 13 in a thickness direction thereof as shown by arrow A in FIG. 2. The vibration of the diaphragm sheet 14 is directly transmitted to the driven film 241, and the driven film 241 is vibrated similarly in the direction shown by arrow A, too. Capacity of the pump room 25 is increased and decreased by the vibration of the driven film 241. When the capacity of the pump room 25 is decreased, pressure in the pump room 25 is increased, so that the suction valve 23*a* is closed, and the discharge valve 23*b* is opened. Thereby, the fluid in the pump room 25 is discharged through the discharge valve 23*b* to the discharge pipe 22*b*. On the contrary, when the capacity of the pump room 25 is increased, the pressure in the pump room 25 is decreased, so that the discharge valve 23*b* is closed, and the suction valve 23*a* is opened. Thereby, the fluid is sucked into the pump room 25 from the suction pipe 22*a* through the suction valve 23*a*.

In the piezoelectric-driven diaphragm pump P of the first embodiment, since the outside face 14*b* of the diaphragm sheet 14 of the driving diaphragm 12 is the form of concave with respect to the reference plane 11*b*, and the outside face 241*a* of the driven film 241 is the form of concave with respect to the reference plane 11*b*, the outside face 241*a* of the driven film 241*d* can be contacted with the outside face 14*b* of the diaphragm sheet 14 smoothly when the driven unit 2 is exchanged. Therefore, a defect such that air enters into a contact portion of the outside face 241*a* of the driven film 241 and the outside face 14*b* of the diaphragm sheet 14 rarely occurs, so that the contact condition of the outside face 241*a* of the driven film 241 and the outside face 14*b* of the diaphragm sheet 14 can be provided surely. Furthermore, the center portion of the outside 241*a* of the driven film 241 comes in contact with the center portion of the outside 14*b* of the diaphragm sheet 14 surely, so that the displacement at the center of the diaphragm sheet 14 which is the largest among the displacements of the driving diaphragm 12 in the thickness direction thereof can be utilized to a maximum extent. Still furthermore, the driving diaphragm 12 and the driven film 241 are directly contacted with no transmission medium, so that transmission efficiency of vibration can be increased higher, and the driven film 241 can follow a high-speed vibration of the driving diaphragm 12. Thus, it is possible to provide the piezoelectric-driven diaphragm pump P which is superior in rapidity and high efficiency.

Second Embodiment

Figure 3A:
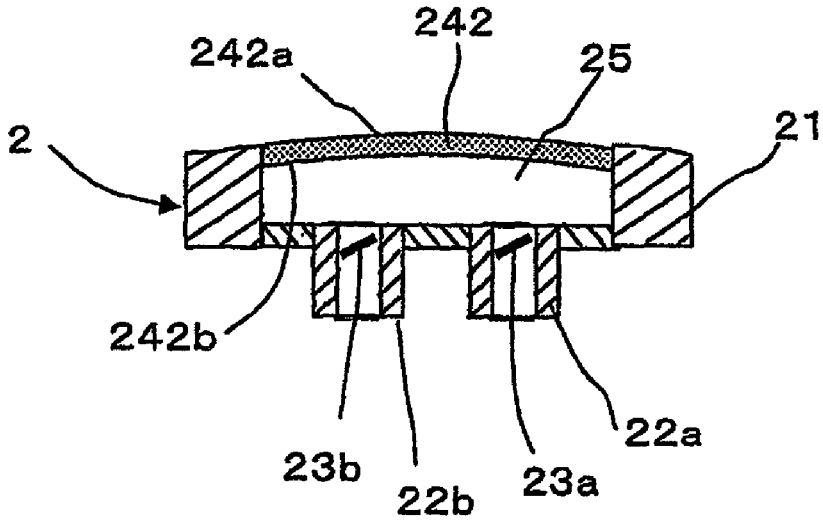
FIG. 3A is a sectional view showing a configuration of a driven unit of a piezoelectric-driven diaphragm pump in accordance with a second embodiment of the present invention.

Subsequently, a piezoelectric-driven diaphragm pump in accordance with a second embodiment of the present invention is described with reference to FIGS. 3A and 3B. FIG. 3A shows a driven unit 2 of the piezoelectric-driven diaphragm pump P in the second embodiment, and FIG. 3B shows the piezoelectric-driven diaphragm pump P using the driven unit 2.

Figure 3B:
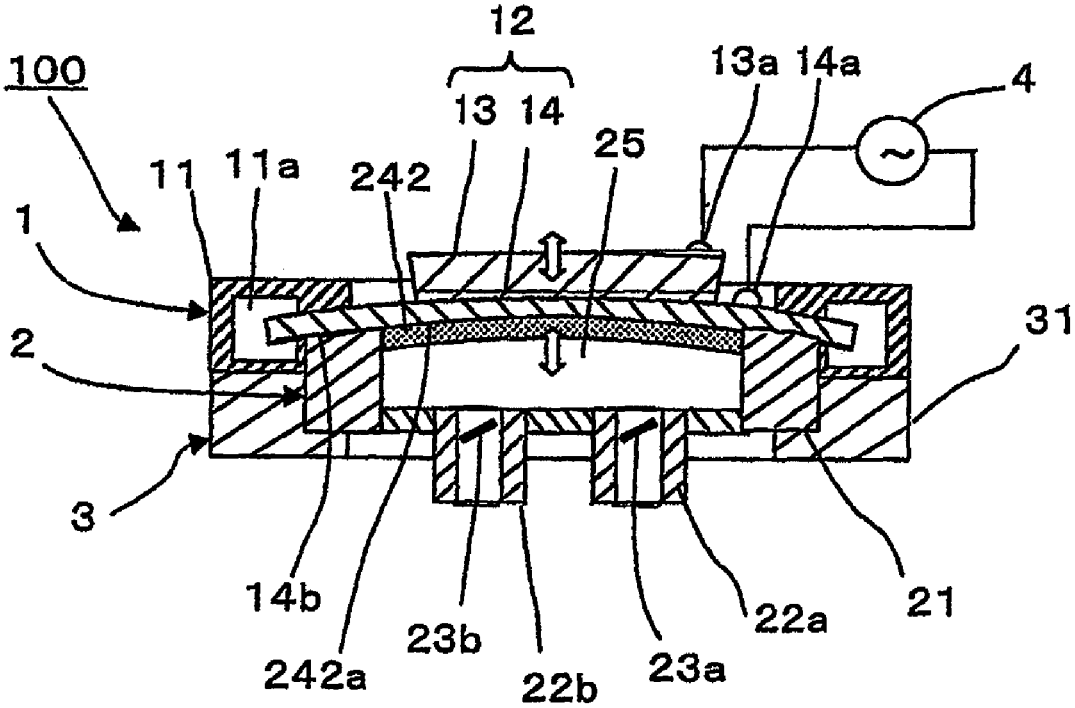
FIG. 3B is a sectional view showing a configuration of the piezoelectric-driven diaphragm pump in the second embodiment.

As shown in FIGS. 3A and 3B, a driven film 242 of the driven unit 2 is formed in a convexity having a uniform thickness (for example, 0.2 mm) and made of a material similar to the material of the driven film 241 in the first embodiment. In other words, the second embodiment is different from the above first embodiment at a point that the driven film 242 of the driven unit 2 is formed in the convexity with having a uniform thickness. Besides, other configuration of the piezoelectric-driven diaphragm pump P in the second embodiment is similar to those in the first embodiment, so that the same or similar elements are coded by the same numerals, and thereby, the description of them is omitted. (The same goes for the following embodiments.)

Third Embodiment

Figure 4A:
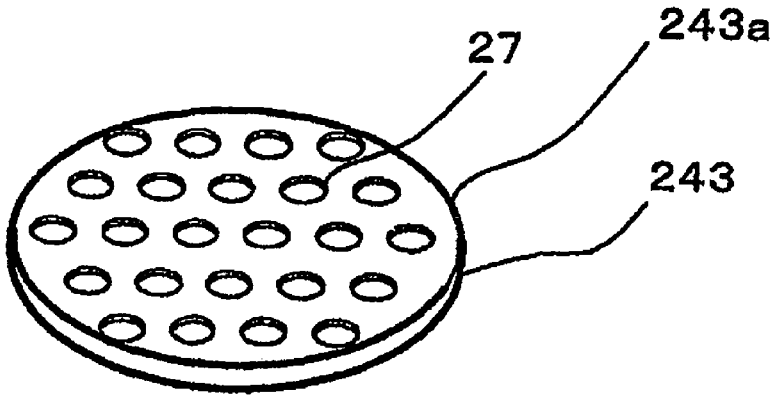
FIG. 4A is a perspective view showing a configuration of a driven film in a piezoelectric-driven diaphragm pump in accordance with a third embodiment of the present invention.

Subsequently, a piezoelectric-driven diaphragm pump in accordance with a third embodiment of the present invention is described with reference to FIGS. 4A and 4B. FIG. 4A shows a driven film 243 of the piezoelectric-driven diaphragm pump P in the third embodiment, and FIG. 4B shows the piezoelectric-driven diaphragm pump P using the driven unit 2.

The third embodiment is different from the above first embodiment at a point that an elongation coefficient per unit stress in an in-plane direction (radial direction) of the driven film 243 of the driven unit 2 is made larger than an elongation coefficient per unit stress in a direction perpendicular to the in-plane direction. A cross-sectional shape of the driven film 243 in a thickness direction thereof is formed so that an outside face 243*a* facing the driving diaphragm 12 is a convexity having a vertex protruding toward the driving diaphragm 12 at the center of a circular form in a plane view, and an inside face 243*b* at a side of the pump room 25 is a plane, like the first embodiment.

In order to have the above-mentioned characteristic, the driven film 243 is made of a material similar to that in the first embodiment, and depressions 27 having a diameter of 1 mm and a depth of 0.1 mm are evenly formed on the outside face 243*a* of the driven film 243. By such a configuration, thickness distribution of the driven film 243 in the radial direction is not uniform and made partially thinner due to existence of the depressions 27, so that mechanical strength against a force in the radial direction becomes weak, substantially. In other words, when a force is applied to the driven film 243 in the radial direction, transformation of the portion where the depression 27 is formed becomes larger than transformation of other portion. Therefore, the elongation coefficient per unit stress in the radial direction becomes larger in comparison with a case where no depression is formed, so that the driven film 243 can be transformed easily. On the other hand, as for the transformation of the driven film 243 in the thickness direction, a force applied to the driven film 243 is not directly transmitted to the portion where the depression 27 is formed, and transmitted to the other portion where no depression is formed. Therefore, the elongation coefficient per unit stress in the thickness direction hardly differs from that in the case where no depression is formed. Accordingly, the driven film 243 is easily transformed in the radial direction but not easily transformed in the thickness direction.

Figure 4B:
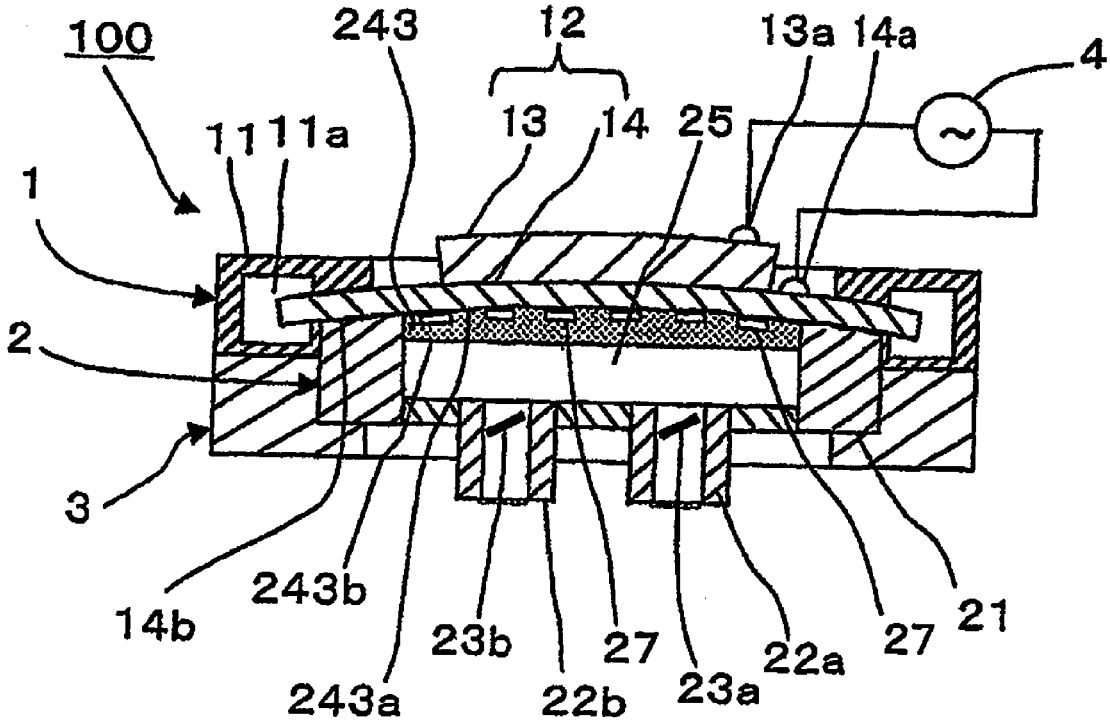
FIG. 4B is a sectional view showing a configuration of the piezoelectric-driven diaphragm pump in the third embodiment.

When an alternating voltage is applied to the piezoelectric element 13 in the driving diaphragm 12 shown in FIG. 4B, the driving diaphragm 12 is vibrated in the thickness direction depending on the expansion and contraction of the piezoelectric element 13 in the radial direction. When the vibration of the driving diaphragm 12 is transmitted to the driven film 243, a force transmitted to the driven film 243 from a vibration transmitting face (that is, the outside face 14*b* of the diaphragm sheet 14) of the driving diaphragm 12 is applied to the driven film 243 in both of the radial orientation and the thickness direction from the center portion of the driven film 243, since the outside face 243*a* of the driven film 243 is convex with respect to the reference plane 11*b*.

As mentioned above, since the elongation coefficient per unit stress in the radial direction is larger due to the existence of the depression 27, the driven film 243 is easy to be transformed in the radial direction, and a resistance due to the driving film 243 disturbing the transformation of the driving diaphragm 12 becomes smaller. In addition, the driven film 243 displaces similar to the case where no depression is formed in the thickness direction, so that the displacement of the driving diaphragm 12 is easily transmitted to the driven film 243. As a result, the capacity of the pump room 25 of the driven unit 2 can be varied largely.

In this way, the driven film 243 that the thickness is partially made thinner by forming the depressions 27 is used for the driven unit 2, it is possible to make the driven film 243 easily transformable in the radial direction but hardly transformable in the thickness direction. As a result, the displacement of the driving diaphragm 12 can be transmitted to the driven film 243 surely, and the movement of the driving diaphragm 12 can be used effectively.

In addition, even when protrusions are formed on the outside face 243*a* of the driven film 243 instead of the depressions 27, substantially the same advantageous effect can be provided. Furthermore, the shape of the depressions or the protrusions is not necessarily the circular shape. Still furthermore, even when the driven film 243 is formed by lamination of a plurality of films, the same advantageous effect can be provided.

Fourth Embodiment

Figure 5A:
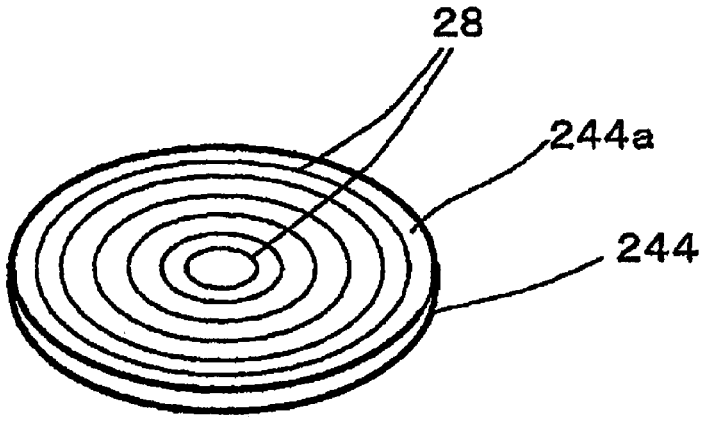
FIG. 5A is a perspective view showing a configuration of a driven film in a piezoelectric-driven diaphragm pump in accordance with a fourth embodiment in the present invention.

Subsequently, a piezoelectric-driven diaphragm pump in accordance with a fourth embodiment of the present invention is described with reference to FIGS. 5A and 5B. FIG. 5A show a driven film 244 of the piezoelectric-driven diaphragm pump P in the fourth embodiment, and FIG. 5B shows the piezoelectric-driven diaphragm pump P using the driven film 244.

In the fourth embodiment, the driven film 244 of the driven unit 2 has a characteristic that rate of elongation per unit stress in an in-plane direction (radial direction) thereof is larger than rate of elongation per unit stress in a direction perpendicular to the in-plane direction. Therefore, the fourth embodiment is different from the above third embodiment at a point that a plurality of circular grooves 28 is concentrically formed on an outside face 244*a* of the driven film 244. In addition, a cross-sectional shape of the driven film 244 in a thickness direction thereof is formed so that the outside face 244*a* facing the driving diaphragm 12 is a convexity having a vertex protruding toward the driving diaphragm 12 at the center of a circular form in a plane view, and an inside face 244*b* at a side of the pump room 25 is a plane, like the first and third embodiments.

The driven film 244 is made of a material similar to that in the first embodiment, and the circular grooves 28 respectively having a depth of 0.1 mm and different diameters are formed at a predetermined constant pitch on the outside face 244*a* of the driven film 244 in order to obtain the above-mentioned characteristic. The driven film 244 formed as above is discontinuity in the radial direction due to the existence of the circular grooves 28, so that mechanical strength of the driven film 244 in the radial direction is lower, substantially. Therefore, when a force is applied to the driven film 244 in the radial direction, it is easily transformed, and the rate of elongation per unit stress in the radial direction becomes larger in comparison with a case that no circular groove is formed. On the other hand, since the driven film 244 is continuous in the thickness direction, the driven film 244 displaces similar to the case that no circular groove is formed.

Figure 5B:
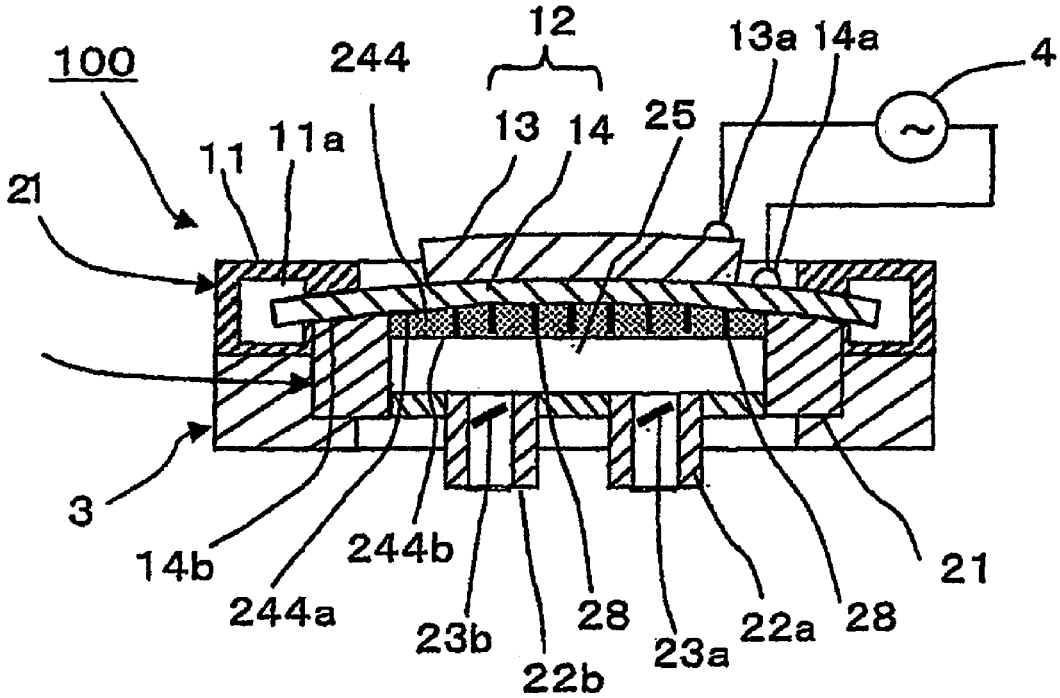
FIG. 5B is a sectional view showing a configuration of the piezoelectric-driven diaphragm pump of the fourth embodiment.

When an alternating voltage is applied to the piezoelectric element 13 of the driving diaphragm 12 shown in FIG. 5B, and the driving diaphragm 12 is vibrated, the vibration of the driving diaphragm 12 is transmitted to the center portion of the driven film 244, and the vibration is further transmitted in both of the radial direction and the thickness direction of the driven member 244. Since the driven film 244 is discontinuous in the radial direction and the elongation per unit stress in the radial direction is larger, the resistance of the driven film 244 against the transformation of the driving diaphragm 12 becomes smaller. On the other hand, the driven film 244 transforms similar to the case that no circular groove is formed in the thickness direction, so that the transformation of the driving diaphragm 12 can easily be transmitted to the driven film 244. Therefore, the displacement of the driving diaphragm 12 can be transmitted to the driven film 244 surely, and the capacity of the pump room 25 of the driven unit 2 can be varied largely.

By suing the driven film 244 which is discontinuous in the radial direction by the circular grooves 28, the driven film 244 can be extendable in the radial direction, so that the displacement of the driving diaphragm 12 can be transmitted to the driven film 244 surely. As a result, the displacement of the driving diaphragm 12 can be utilized effectively, and the efficiency of the piezoelectric-driven diaphragm pump P can be increased.

As for the shape of the driven film 244, it is possible to provide the circular grooves 28 on the inside face 244*b* of the driven film 244 at the side of the pump room 25 of the driven unit 2. Furthermore, it is possible to be provided the same advantageous effect by forming the driven film 244 of lamination of a plurality of films so as to increase the transformation in the radial direction.

Fifth Embodiment

Figure 6A:
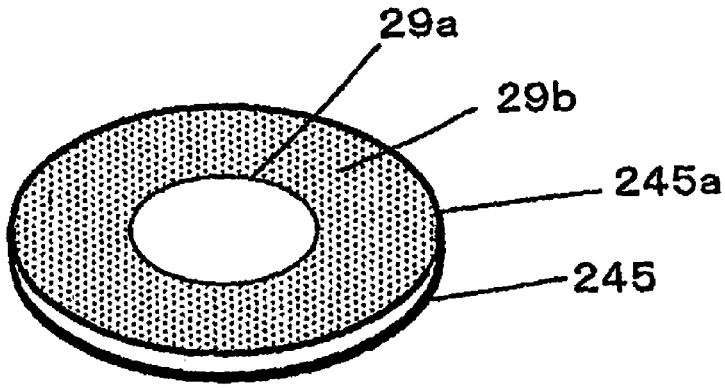
FIG. 6A is a perspective view showing a configuration of a driven film in a piezoelectric-driven diaphragm pump in accordance with a fifth embodiment in the present invention.

Subsequently, a piezoelectric-driven diaphragm pump in accordance with a fifth embodiment of the present invention is described with reference to FIGS. 6A and 6B. FIG. 6A show a driven film 245 of the piezoelectric-driven diaphragm pump P in the fifth embodiment, and FIG. 6B shows the piezoelectric-driven diaphragm pump P using the driven film 245.

The fifth embodiment is different from the above first embodiment at a point that the driven film 245 of the driven unit 2 has a characteristic that elastic coefficient in a center portion 29*a* thereof is made larger than that in a peripheral portion. In addition, a cross-sectional shape of the driven film 245 in a thickness direction thereof is formed so that the outside face 245*a* facing the driving diaphragm 12 is a convexity having a vertex protruding toward the driving diaphragm 12 at the center of a circular form in a plane view, and an inside face 245*b* at a side of the pump room 25 is a plane, like the first and third embodiments.

Figure 6B:
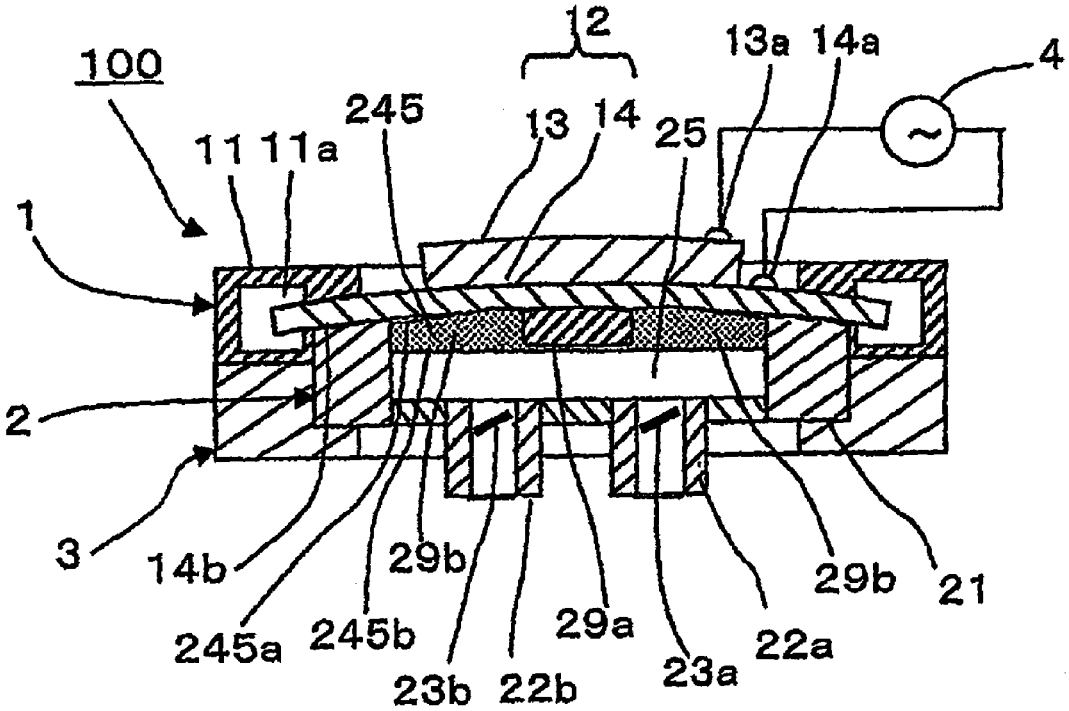
FIG. 6B is a sectional view showing a configuration of the piezoelectric-driven diaphragm pump in the fifth embodiment.

In FIGS. 6A and 6B, the driven film 245 is made of a material such as nitril butadiene rubber (NBR), and a vulcanization process is performed to the center portion 29*a* for having the above-mentioned characteristic. In the vulcanization process, reprocessing is performed to increase sulfur binding into the NBR so as to increase only the hardness of the center portion, and thereby, the elastic coefficient in the center portion 29*a* is increased.

In the driven film 245 formed as above, the elastic coefficient in the peripheral portion 29*b* is smaller than that in the center portion 29*a*, so that the peripheral portion 29*b* can be transformed easier. In other words, the transformation quantity in the radial direction in the peripheral portion 29*b* becomes larger than that in the center portion 29*a*. Therefore, since it is possible to make the transformation in the center portion 29*a* smaller but the transformation in the peripheral portion 29*b* larger, a resistance due to the driven film 245 against the transformation of the driving diaphragm 12 can be made smaller. On the other hand, since the hardness in the center portion 29*a* of the driven film 245, where the transformation by the driving diaphragm 12 becomes the largest, is increased by the above-mentioned vulcanization process, and the elastic coefficient thereof is made larger and the transformation quantity in the center portion 29*a* of the driven film 245 becomes smaller. Consequently, the transmission efficiency of the transformation of the driving diaphragm 12 in the thickness direction can be made larger, so that the capacity of the pump room 25 of the driven unit 2 can be varied larger.

When an alternating voltage is applied to the piezoelectric element 23 of the driving diaphragm 12 shown in FIG. 6B, and the driving diaphragm 12 is vibrated, the vibration of the driving diaphragm 12 is transmitted to the center portion of the driven film 245, and the vibration is further transmitted in both of the radial direction and the thickness direction of the driven member 245. Since the vibration transmitted from the driving diaphragm 12 is easily transmitted in the center portion 29*a* where the transformation quantity of the driving diaphragm 12 is larger by the above-mentioned characteristic of the driven film 245, the piezoelectric-driven diaphragm pump P having a high transmission efficiency can be provided.

In addition, as for the configuration of the driven film 245, it is possible to use a plastic film where the center portion is formed of a material different from the material of the peripheral portion so as to make the hardness in the center portion larger than that in the peripheral portion. Alternatively, it is possible that the center portion is made thicker than the peripheral portion by forming the driven film 245 by laminating a plurality of films. By these transformations, substantially the same advantageous effect can be provided.

Sixth Embodiment

Figure 7A:
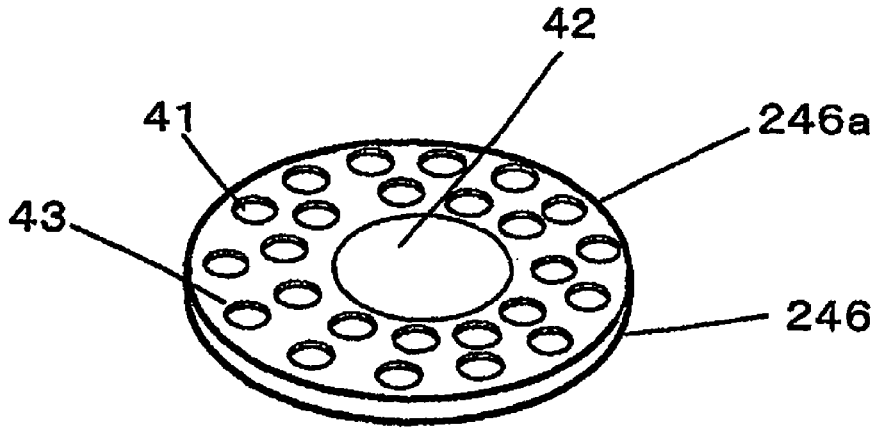
FIG. 7A is a perspective view showing a configuration of a driven film in a piezoelectric-driven diaphragm pump in accordance with a sixth embodiment of the present invention.

Subsequently, a piezoelectric-driven diaphragm pump in accordance with a sixth embodiment of the present invention is described with reference to FIGS. 7A and 7B. FIG. 7A show a driven film 246 of the piezoelectric-driven diaphragm pump P in the sixth embodiment, and FIG. 7B shows the piezoelectric-driven diaphragm pump P using the driven film 246.

The sixth embodiment is different from the above first embodiment at a point that the driven film 246 of the driven unit 2 has a characteristic that an elongation coefficient per unit stress in a radial direction of a peripheral portion 43 of the driven film 246 is made larger than an elongation coefficient per unit stress in a direction perpendicular of a center portion 42 of the driven film 246. A cross-sectional shape of the driven film 246 in a thickness direction thereof is formed so that an outside face 246*a* facing the driving diaphragm 12 is a convexity having a vertex protruding toward the driving diaphragm 12 at the center of a circular form in a plane view, and an inside face 246*b* at a side of the pump room 25 is a plane, like the first embodiment.

The driven film 246 is made of a material similar to that in the first embodiment, and depressions 41 are evenly formed in only a peripheral portion 43 of the outside face 246*a* of the driven film 246. By such a configuration, thickness distribution of the driven film 246 in the radial direction is not uniform and made partially thinner due to existence of the depressions 41, so that mechanical strength against a force in the radial direction becomes weak, substantially. Therefore, the elongation coefficient per unit stress in the radial direction in the peripheral portion 43 becomes larger in comparison with a case where no depression is formed in the peripheral portion 43, so that the driven film 246 can be transformed easily. On the other hand, the thickness of the center portion 42 of the driven film 246 is relatively uniform in the thickness direction rather than that in the peripheral portion 43, so that the peripheral portion 43 of the driven film can easily be transformed in the radial direction but the center portion 42 is not transformed easier. Consequently, the center portion 42 of the driven member 246 is hard to be transformed, so that the vibration of the driving diaphragm 12 can easily transmitted to the center portion 42 of the driven film 246. Accordingly, the vibration of the driving diaphragm 12 can easily be transmitted to the center portion 42 of the driven member 246, so that the transmitting efficiency of the driving diaphragm 12 to the driven member 246 becomes larger. Consequently, the variation of the capacity of the pump room 25 of the driven unit 2 can be made larger.

Figure 7B:
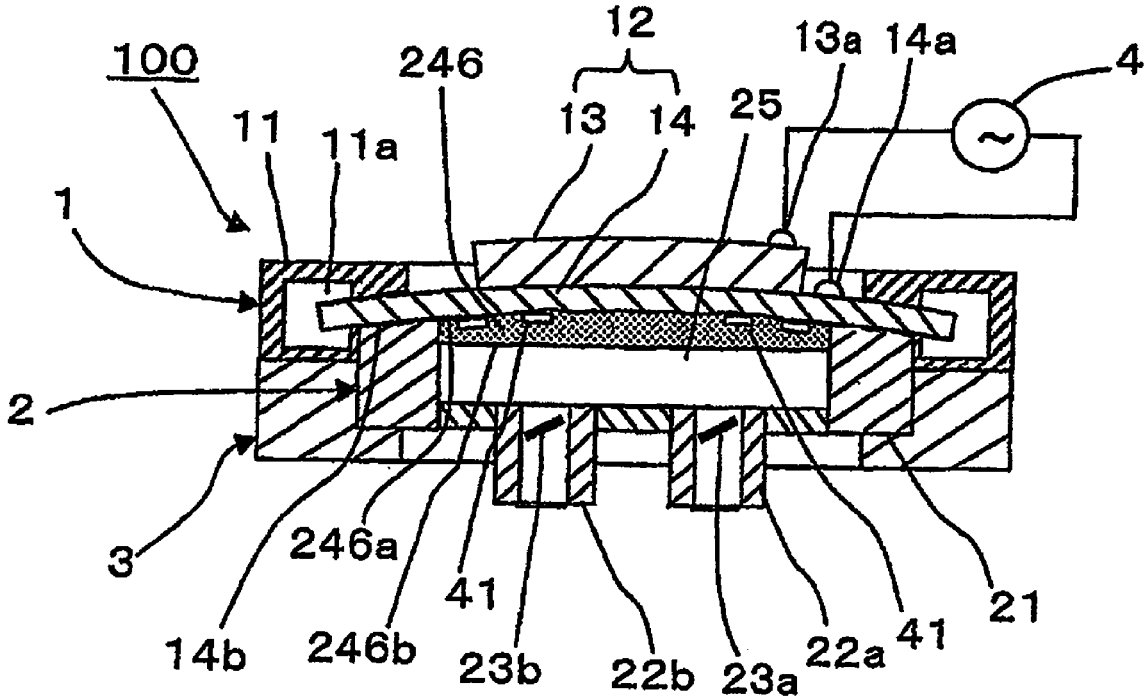
FIG. 7B is a sectional view showing a configuration of the piezoelectric-driven diaphragm pump in the sixth embodiment.

When an alternating voltage is applied to the piezoelectric element 13 of the driving diaphragm 12 shown in FIG. 7B, and the driving diaphragm 12 is vibrated, the vibration of the driving diaphragm 12 is transmitted to the center portion 42 of the driven film 246, and the vibration is further transmitted in both of the radial direction and the thickness direction of the driven member 246. Since the vibration transmitted from the driving diaphragm 12 is easily transmitted in the center portion 42 where the transformation quantity of the driving diaphragm 12 is larger by the above-mentioned characteristic of the driven film 246, the piezoelectric-driven diaphragm pump P having a high transmission efficiency can be provided.

Seventh Embodiment

Figure 8A:
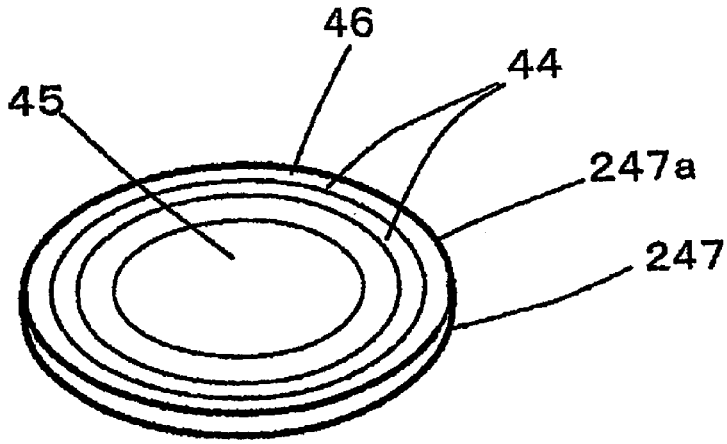
FIG. 8A is a perspective view showing a configuration of a driven film in a piezoelectric-driven diaphragm pump in accordance with a seventh embodiment of the present invention.

Subsequently, a piezoelectric-driven diaphragm pump in accordance with a seventh embodiment of the present invention is described with reference to FIGS. 8A and 8B. FIG. 8A show a driven film 247 of the piezoelectric-driven diaphragm pump P in the seventh embodiment, and FIG. 8B shows the piezoelectric-driven diaphragm pump P using the driven film 247.

The seventh embodiment is different from the above sixth embodiment at a point that the driven film 247 of the driven unit 2 has a characteristic that an elongation coefficient per unit stress in a radial direction of a peripheral portion 46 of the driven film 247 is made larger than an elongation coefficient per unit stress in a direction perpendicular of a center portion 45 of the driven film 247. A cross-sectional shape of the driven film 247 in a thickness direction thereof is formed so that an outside face 247*a* facing the driving diaphragm 12 is a convexity having a vertex protruding toward the driving diaphragm 12 at the center of a circular form in a plane view, and an inside face 247*b* at a side of the pump room 25 is a plane, like the first and sixth embodiments.

The driven film 247 is made of a material similar to that in the first embodiment, and circular grooves 44 are concentrically formed at a predetermined constant pitch in only the peripheral portion 46 of the outside face 247*a* of the driven film 247. By such a configuration, the driven film 247 becomes discontinuous in the radial direction by the existence of the circular grooves 44, so that mechanical strength against a force in the radial direction becomes weak, substantially. Therefore, the elongation coefficient per unit stress in the radial direction in the peripheral portion 46 becomes larger in comparison with a case where no circular groove is formed in the peripheral portion 46, so that the driven film 247 can be transformed easily. On the other hand, the elongation coefficient per unit stress in the radial direction in the center portion 45 of the driven film 247 is not different from that in the case where no circular groove is formed, so that the center portion 45 of the driven film is not easy to be transformed rather than the peripheral portion 46. In other words, the transformation of the driving diaphragm 12 can easily transmitted to the center portion 45 of the driven film 247. Accordingly, resistance against the transformation of the driving diaphragm 12 due to the driven film 247 becomes smaller, so that the transmitting efficiency of the driving diaphragm 12 to the driven member 247 becomes larger. Consequently, the variation of the capacity of the pump room 25 of the driven unit 2 can be made larger.

Figure 8B:
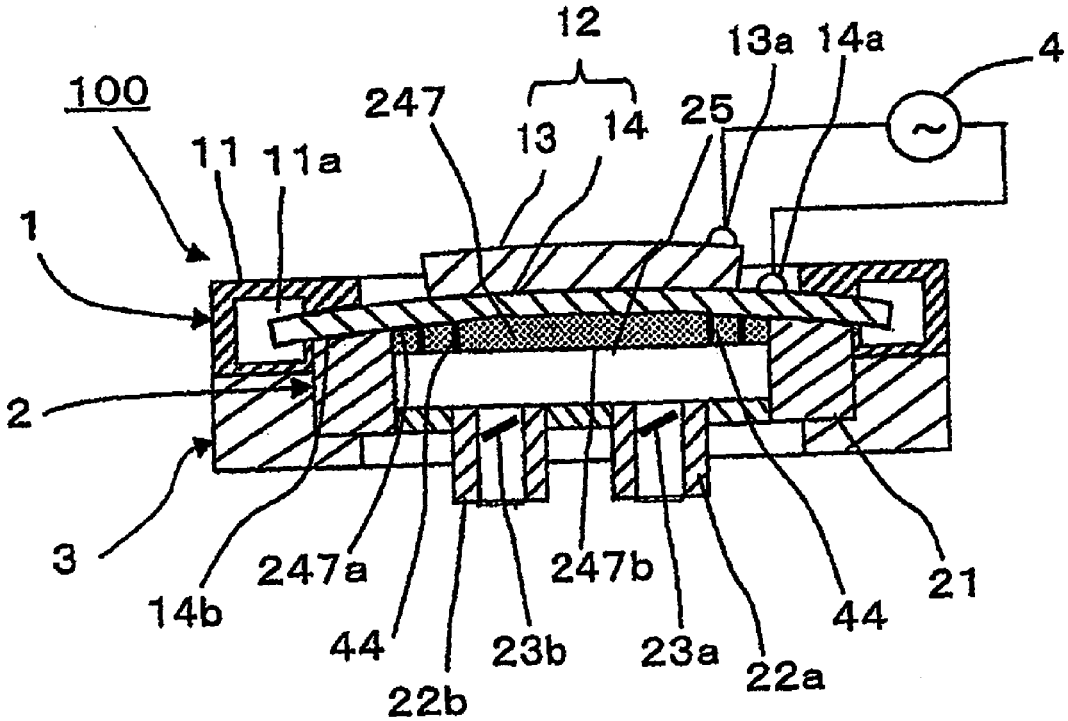
FIG. 8B is a sectional view showing a configuration of the piezoelectric-driven diaphragm pump in the seventh embodiment.

When an alternating voltage is applied to the piezoelectric element 13 of the driving diaphragm 12 shown in FIG. 8B, and the driving diaphragm 12 is vibrated, the vibration of the driving diaphragm 12 is transmitted to the center portion 45 of the driven film 247, and the vibration is further transmitted in both of the radial direction and the thickness direction of the driven member 247. Since the vibration transmitted from the driving diaphragm 12 is easily transmitted in the center portion 45 where the transformation quantity of the driving diaphragm 12 is larger by the above-mentioned characteristic of the driven film 247, the piezoelectric-driven diaphragm pump P having a high transmission efficiency can be provided.

Eighth Embodiment

Figure 9:
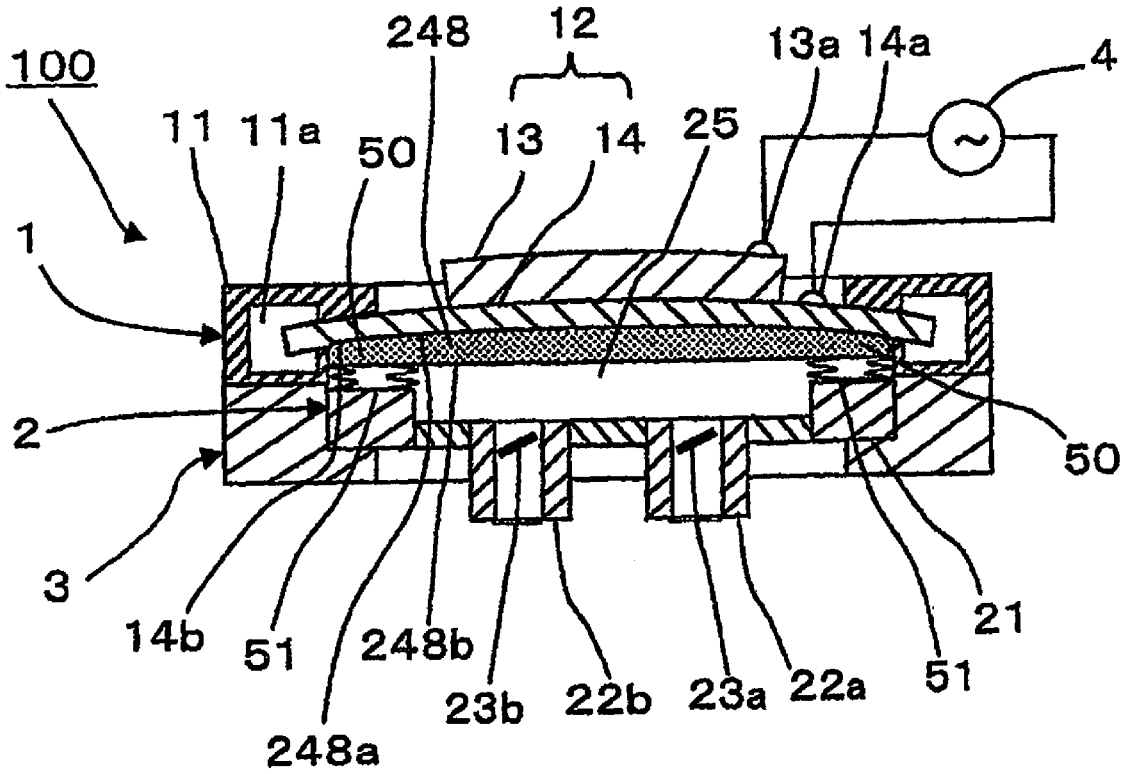
FIG. 9 is a sectional view showing a configuration of a piezoelectric-driven diaphragm pump in accordance with an eighth embodiment of the present invention.

Subsequently, a piezoelectric-driven diaphragm pump in accordance with an eighth embodiment of the present invention is described with reference to FIG. 9. FIG. 9 shows the piezoelectric-driven diaphragm pump P. The eighth embodiment is different from the above first embodiment at a point that a bellows 51 is integrally formed with a peripheral portion 50 of a driven film 248 of the driven unit 2. A cross-sectional shape of the driven film 248 in a thickness direction thereof is formed so that an outside face 248*a* facing the driving diaphragm 12 is a convexity having a vertex protruding toward the driving diaphragm 12 at the center of a circular form in a plane view, and an inside face 248*b* at a side of the pump room 25 is a plane, like the first embodiment.

Since the bellows 51 of the driven film 248 is formed like corrugation along whole circumference of the peripheral portion 50 of the driven film 248, it can move like a soft cushion, and thereby, the bellows 51 can be followed flexibly to the variation of the pressure in the vicinity of the peripheral portion 50 of the driven film 248.

When an alternating voltage is applied to the piezoelectric element 13 of the driving diaphragm 12, and the driving diaphragm 12 is vibrated, the vibration of the driving diaphragm 12 is transmitted to the center portion of the driven film 248, and the vibration is further transmitted in both of the radial direction and the thickness direction of the driven member 248. When a force is applied to the driven film 248 in the radial direction, the driven film 248 can easily be transformed in the radial direction by the existence of the bellows 51, so that it is possible to ensure the close contact of the driven film 248 with the driving diaphragm 12.

Since the driven film 248 can easily be transformed in the radial direction by providing the bellows 51 on the driven film 248, a resistance against the transformation of the driving diaphragm 12 due to the driven film 248 becomes smaller. Consequently, the transmission efficiency of the transformation of the driving diaphragm 12 in the thickness direction can be made larger, so that the capacity of the pump room 25 of the driven unit 2 can be varied larger.

In addition, it is possible to be provided the similar advantageous effect by adding a ring shaped member made of a material having an elastic coefficient different from that of a material of the driven film 248. Alternatively, the bellows 51 may be an independent member from the driven film 248.

According to the piezoelectric-driven diaphragm pump P of the above-mentioned first to eighth embodiments, since the outside faces 241*a* to 248*a* of the driven films 241 to 248 are made convex with respect to the reference plane 11*b* of the first housing 11 of the driving unit 1, contact of the of the outside faces 241*a* to 248*a* of the driven films 241 to 248 with the outside face 14*b* of the diaphragm sheet 14 can be performed smoothly without occurrence of defect such as air entered between these contacting faces, when the driven unit 2 is replaced. Thereby, the condition that each of the driven films 241 to 248 is closely contacted with the diaphragm sheet 14 of the driving diaphragm 12 can be obtained surely. Consequently, the vibration of the driving diaphragm 12 can directly be transmitted to each of the driven films 241 to 248, so that the piezoelectric-driven diaphragm pumps having high transmission efficiency can be ensured, even when the driven unit 2 is replaced.

Furthermore, since each of the driven films 241 to 248 is directly contacted to the diaphragm sheet 14 of the driving diaphragm 12 with no transmission medium such as air or fluid intervening between them, the driven films 241 to 248 can be followed to high-speed vibration of the driving diaphragm 12. Consequently, the piezoelectric-driven diaphragm pump having high-speed performance can be ensured, even when the driven unit 2 is replaced.

Ninth Embodiment

Figure 10:
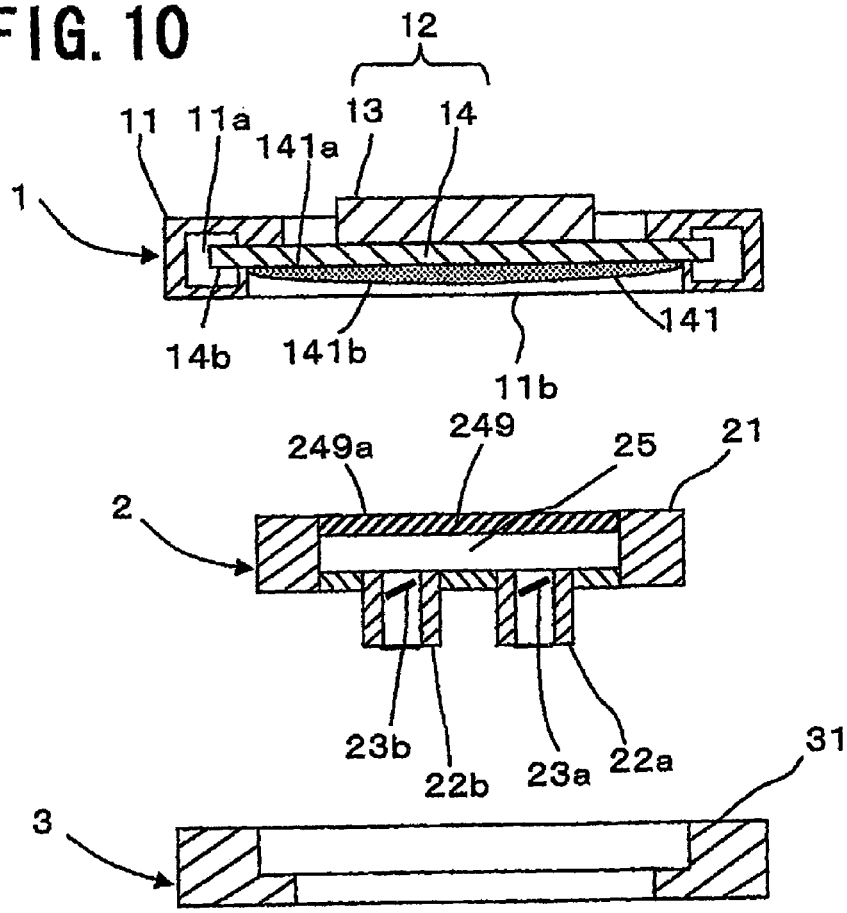
FIG. 10 is an exploded sectional view showing a configuration of a piezoelectric-driven diaphragm pump in accordance with a ninth embodiment of the present invention.
Figure 11:
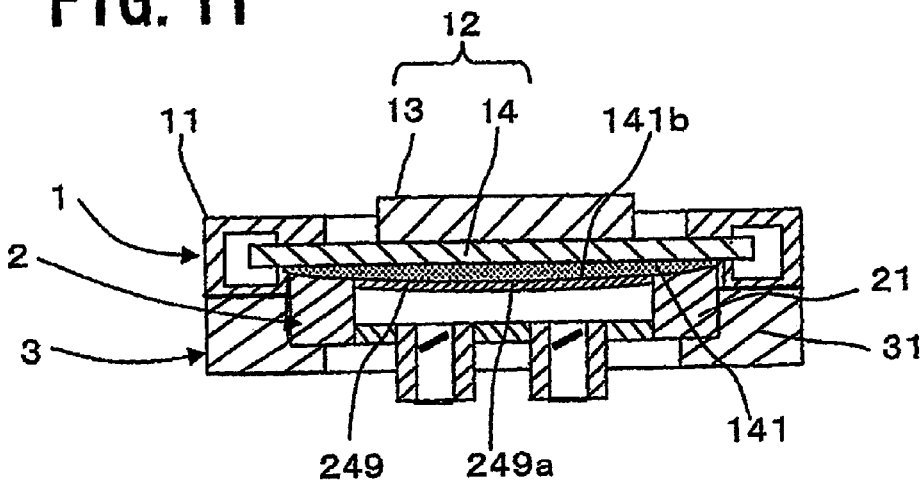
FIG. 11 is a sectional view showing a configuration of the piezoelectric-driven diaphragm pump in the ninth embodiment.

Subsequently, a piezoelectric-driven diaphragm pump in accordance with a ninth embodiment of the present invention is described with reference to FIGS. 10 and 11. FIG. 10 shows a configuration of the piezoelectric-driven diaphragm pump P when it is disassembled into each of units, and FIG. 11 shows a configuration of the piezoelectric-driven diaphragm pump P when the units shown in FIG. 10 are assembled.

In the piezoelectric-driven diaphragm pump P in the ninth embodiment shown in FIGS. 9 and 10, the driving unit 1 is comprised of a driving diaphragm 12 configured by adhering a circular piezoelectric element (PZT) 13 on a circular diaphragm sheet 14 made of, for example, brass sheet, a first housing 11 on which the driving diaphragm 12 is fixed, and a displacement transmission member 141 adhered on the outside face of the diaphragm sheet 14 of the driving diaphragm 12. The first housing 11 is a resin formed object made of a plastic (for example, polyacetal (POM), poly carbonate (PC), poly phenyl styrene (PPS)) molded as a cylindrical shape. The displacement transmission member 141 is made of, for example, butadiene acrylonitrile rubbers (NBR).

A planar shape of the displacement transmission member 141 is substantially a circle, and a cross-sectional shape thereof in a thickness direction is formed so that an outside face 141*b* facing the driven film 249 is a convexity having a vertex protruding toward the driven film 249 at the center of a circular plan view, and an inside face 141*a* at a side of the diaphragm sheet 14 is a planar shape. In addition, thicknesses of the diaphragm sheet 14 and the driven film 249 are even and substantially parallel to the reference plane 11*b*. As an example, the piezoelectric element 13 has a diameter of 14 mm, and a thickness of 0.13 mm, and the diaphragm sheet 14 has a diameter of 20 mm and a thickness of 0.10 mm.

When it is started to fit the second housing 21 of the driven unit 2 to the first fitting portion 15 of the first housing 11 of the driving unit 1, the outside face 141*a* of the displacement transmission member 141 starts to contact to the outside face 249*a* of the driven film 249 from the center portion. When the second housing 21 of the driven unit 2 is completely fitted to the first fitting portion 15 of the first housing 11, the outside face 141*a* of the displacement transmission member 141 contacts entire of the outside face 249*a* of the driven film 249, closely. In the ninth embodiment, the displacement transmission member 141 is attached to an outer face 14*b* of the diaphragm sheet 14 facing the driven film 249, and the outside face 141*b* of the displacement transmission member 141 facing the driven film 249 serves as the vibration transmitting face of the driving diaphragm 12, and the outside face 249*a* of the driven film 249 serves as a vibration transmitted face to which the displacement of the driving diaphragm 12 is transmitted. In addition, the vibration transmitting face of the driving diaphragm 12 (that is, the outside face 141*b* of the displacement transmission member 141) is the convexity with respect to the reference plane 11*b* of the first housing 11, and the vibration transmitted face of the driven film 249 (that is, the outside face 249*a* of the driven film 249) is parallel to the reference plane 11*b*.

In this way, by forming the shape of the outside face 141*b* of the displacement transmission member 141 convexity with respect to the reference plane 11*b*, the contact of the vibration transmitting face of the driving diaphragm 12 can be contacted with the vibration transmitted face of the driven film 249, smoothly. Therefore, the contact condition of the displacement transmission member 141 and the driven film 249 after fixing the driven unit 2 on the driving unit 1 can be ensured without the occurrence of the defect such as air entering in between them. Furthermore, since the center portion of the driving diaphragm 12 can contact with the driven film 249 surely, the displacement at the center of the driving diaphragm 12 which is the largest can be utilized at a maximum.

Tenth Embodiment

Figure 12:
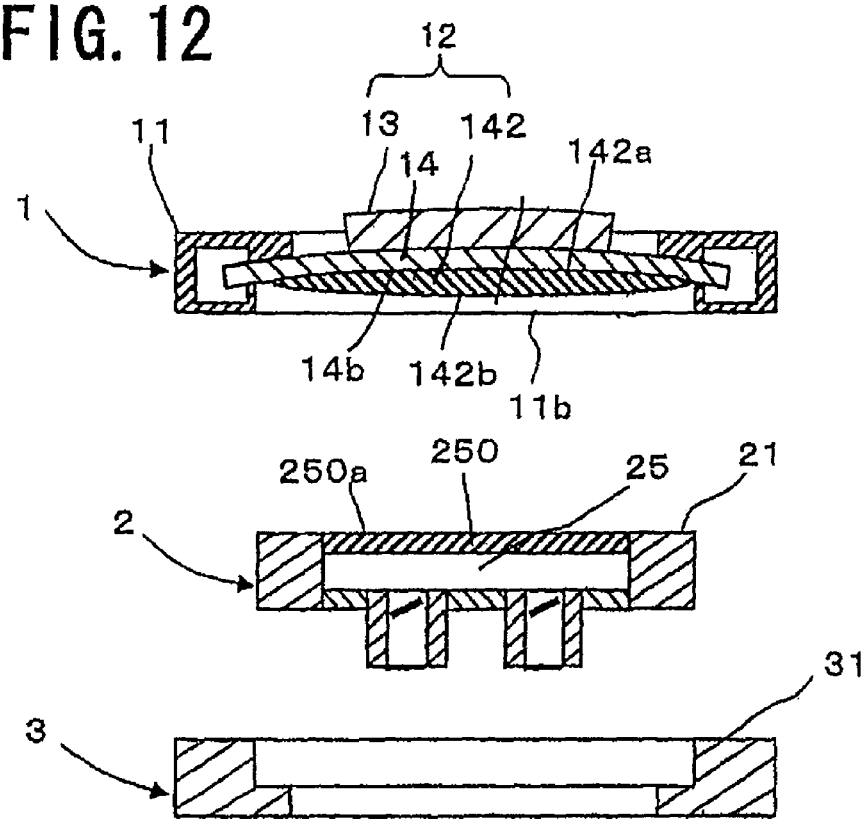
FIG. 12 is an exploded sectional view showing a configuration of a piezoelectric-driven diaphragm pump in accordance with a tenth embodiment of the present invention.
Figure 13:
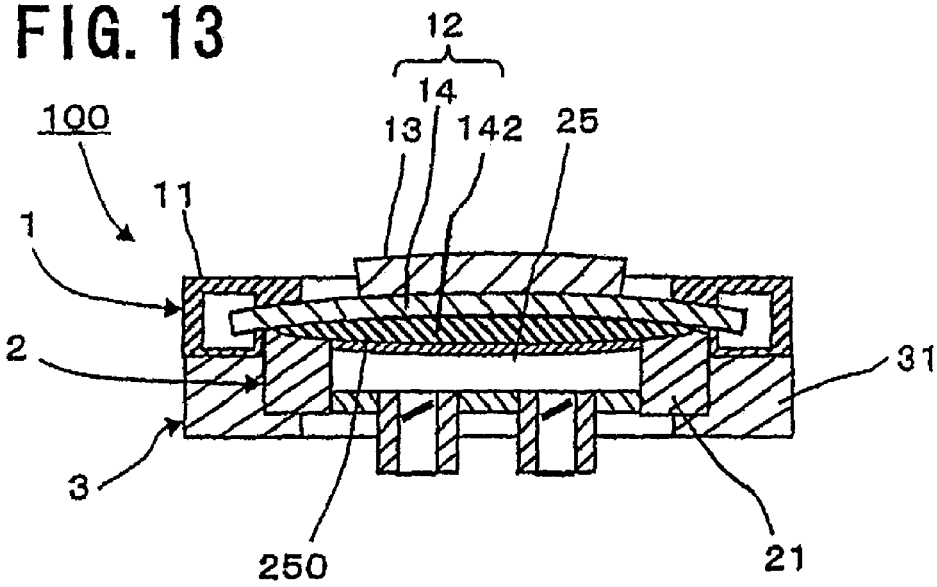
FIG. 13 is a sectional view showing a configuration of the piezoelectric-driven diaphragm pump in the tenth embodiment.

Subsequently, a piezoelectric-driven diaphragm pump in accordance with a tenth embodiment of the present invention is described with reference to FIGS. 12 and 13. FIG. 12 shows a configuration of the piezoelectric-driven diaphragm pump P when it is disassembled into each of units, and FIG. 13 shows a configuration of the piezoelectric-driven diaphragm pump P when the units shown in FIG. 12 are assembled.

In the piezoelectric-driven diaphragm pump P in the tenth embodiment, a diaphragm sheet 14 of the driving diaphragm 12 is curved by about 0.2 mm concavely with respect to the reference plane 11*b*, and an inside face 142*a* of the displacement transmission member 142 is curved concavely with reference to the reference plane 11*b*, too. On the other hand, an outside face 142*b* of the displacement transmission member 142 is curved convexly with respect to the reference plane 11*b*. That is, the driving diaphragm has a displacement transmission member attached to a face of the diaphragm sheet facing the driven film, and a face of the displacement transmission member facing the driven film serves as (or defines) the vibration transmitting face of the driving diaphragm. As for the displacement transmission member 142, an NBR film having a thickness of 0.5 mm at the center portion and a thickness of 0.2 mm at the peripheral portion. The displacement transmission member 142 is attached to the diaphragm sheet 14 of the driving diaphragm 12 by, for example, an adhesive. Other configurations of the piezoelectric-driven diaphragm pump P are substantially the same as those in the above ninth embodiment.

In this way, since the cross-sectional shape of the displacement transmission member 142 formed to be biconvex in the thickness direction, it is possible to use a heat-hardening resin for attaching the displacement transmission member 142 to the diaphragm sheet 14, further to the advantageous effect of the above ninth embodiment. Thereby, the manufacturing of the piezoelectric-driven diaphragm pump P can be made easier.

Eleventh Embodiment

Figure 14A:
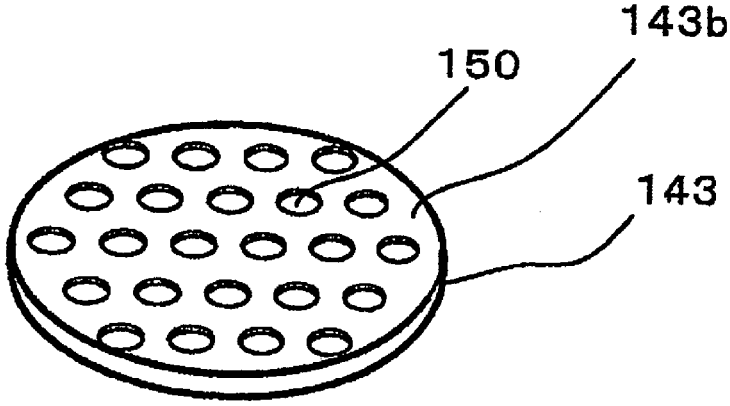
FIG. 14A is a perspective view showing a configuration of a displacement transmitting member in accordance with an eleventh embodiment of the present invention observed from bottom side.

Subsequently, a piezoelectric-driven diaphragm pump in accordance with an eleventh embodiment of the present invention is described with reference to FIGS. 14A and 14B. FIG. 14A shows a configuration of a displacement transmission member 143 in the eleventh embodiment, and FIG. 14B shows a configuration of the piezoelectric-driven diaphragm pump P using the displacement transmission member 143.

In the piezoelectric-driven diaphragm pump P in the eleventh embodiment, a diaphragm sheet 14 of the driving diaphragm 12 is curved concavely with respect to the reference plane 11*b*, and an NBR film having a thickness of 0.5 mm at the center portion and a thickness of 0.2 mm at the peripheral portion is used as the displacement transmission member 143, similar to the above tenth embodiment. Circular depressions 150 having a diameter of 1 mm and a depth of 0.1 mm are evenly formed on an outside face 143*b* of the displacement transmission member 143.

In this way, by forming the depressions 150 on the outside face 143*b* of the displacement transmission member 143, rate of transformation per unit stress of the displacement transmission member 143 in an in-plane direction (radial direction) becomes larger than rate of transformation per unit stress of the displacement transmission member 143 in a thickness direction. In comparison with the tenth embodiment shown in FIG. 13, although there is a demerit such as complexity of manufacturing process of the displacement transmission member 143 for forming the depressions 150 on the outside face 143*b*, thickness distribution of the displacement transmission member 143 in the vicinity of the outside face 143*a* becomes uneven and partially made thinner by the depressions 150, so that the mechanical strength against a force applied in the radial direction becomes weak, substantially. Therefore, the displacement transmission member 143 can easily be transformed in the radial direction but can hardly be transformed in the thickness direction.

Figure 14B:
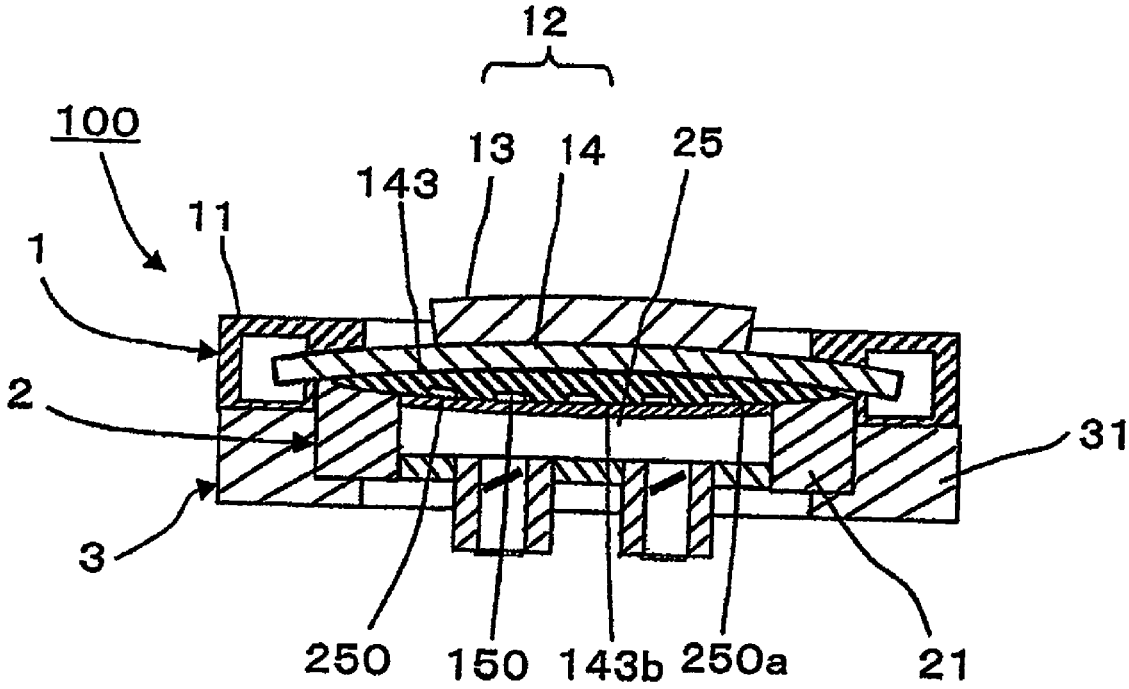
FIG. 14B is a sectional view showing a configuration of a piezoelectric-driven diaphragm pump in the eleventh embodiment.

When an alternating voltage is applied to the piezoelectric element 13 of the driving diaphragm 12 shown in FIG. 14B, the diaphragm sheet 14 is vibrated in the thickness direction with the displacement transmission member 143 following to the expansion and contraction of the piezoelectric element 13 in the radial direction. At that time, since the displacement transmission member 143 is easily transformed in the radial direction, a resistance for disturbing the transformation of the diaphragm sheet 14 due to the displacement transmission member 143 is smaller. On the other hand, the displacement transmission member 143 is transformed in the thickness direction similar to the case where no depression is formed. Thus, the displacement transmission member 143 can transmit the displacement of the diaphragm sheet 14 to the driven film 250 with no damping. As a result, the capacity of the pump room 25 of the driven unit 2 can be varied largely.

In addition, even when protrusions are formed on the outside face 143*b* of the displacement transmission member 143 instead of the depressions 150, substantially the same advantageous effect can be provided. Furthermore, the shape of the depressions or the protrusions is not necessarily the circular shape. Still furthermore, even when the displacement transmission member 143 is formed by lamination of a plurality of films, the same advantageous effect can be provided.

Twelfth Embodiment

Figure 15A:
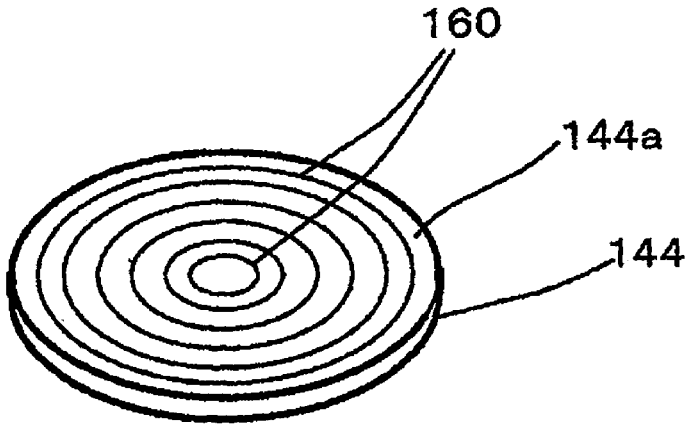
FIG. 15A is a perspective view showing a configuration of a displacement transmitting member in accordance with a twelfth embodiment of the present invention.
Figure 15B:
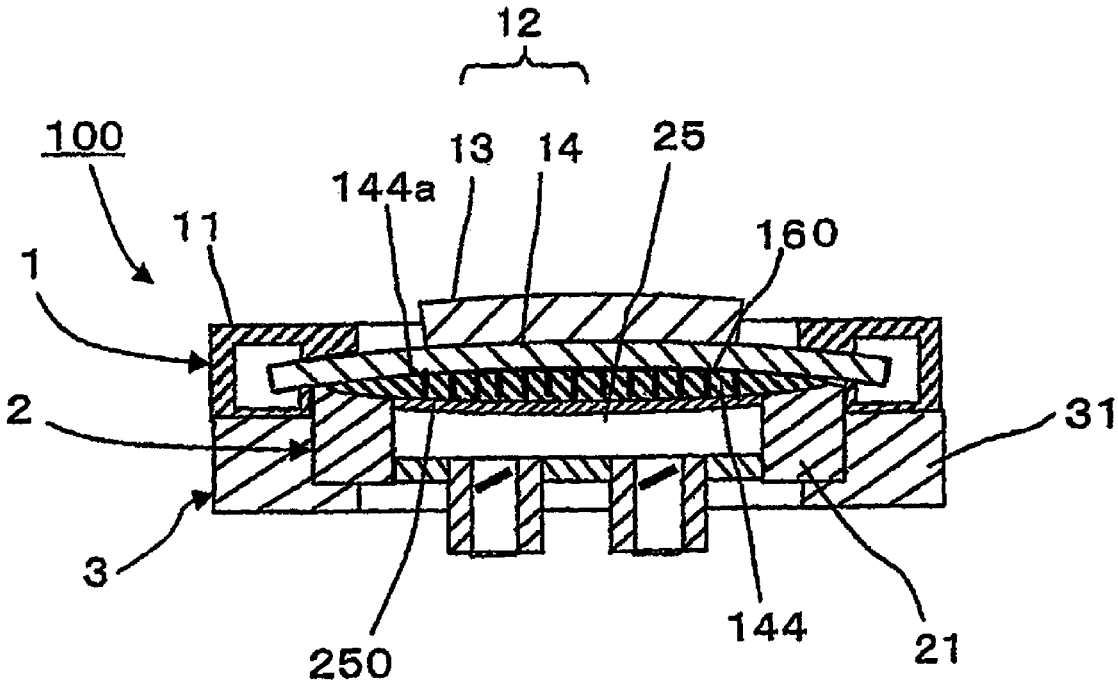
FIG. 15B is a sectional view showing a configuration of the piezoelectric-driven diaphragm pump in the twelfth embodiment.

Subsequently, a piezoelectric-driven diaphragm pump in accordance with a twelfth embodiment of the present invention is described with reference to FIGS. 15A and 15B. FIG. 15A shows a configuration of a displacement transmission member 144 in the twelfth embodiment, and FIG. 15B shows a configuration of the piezoelectric-driven diaphragm pump P using the displacement transmission member 144.

In the piezoelectric-driven diaphragm pump P in the twelfth embodiment, the displacement transmission member 144 is made discontinuous in the radial direction. A diaphragm sheet 14 of the driving diaphragm 12 is curved concavely with respect to the reference plane 11*b*, and an NBR film having a thickness of 0.5 mm at the center portion and a thickness of 0.2 mm at the peripheral portion is used as the displacement transmission member 144. Circular grooves 160 having a depth of 0.1 mm are concentrically formed at a predetermined constant pitch on an inside face 144*a* of the displacement transmission member 144.

In this way, by forming the circular grooves 160 on the inside face 144*a* of the displacement transmission member 144, rate of transformation per unit stress of the displacement transmission member 144 in an in-plane direction (radial direction) becomes larger than rate of transformation per unit stress of the displacement transmission member 144 in a thickness direction, similar to the above eleventh embodiment. In other words, by forming the circular grooves 160 in the vicinity of the inside face 144*a* of the displacement transmission member 144, the displacement transmission member 144 becomes discontinuous in the radial direction in the vicinity of the inside face 144*a*, so that the mechanical strength of the displacement transmission member 144 against a force applied in the radial direction becomes weak, substantially. Therefore, the displacement transmission member 144 can easily be transformed in the radial direction but cannot be transformed in the thickness direction. As a result, the same advantageous effect as that in the above eleventh embodiment can be provided. Furthermore, even when the circular grooves 160 are formed on an outside face 144*b* of the displacement transmission member 144, the same advantageous effect can be provided. Still furthermore, when the displacement transmission member 144 is formed by lamination of a plurality of films so as to make the transformation in the radial direction easier, the same advantageous effect can be provided.

Thirteenth Embodiment

Figure 16:
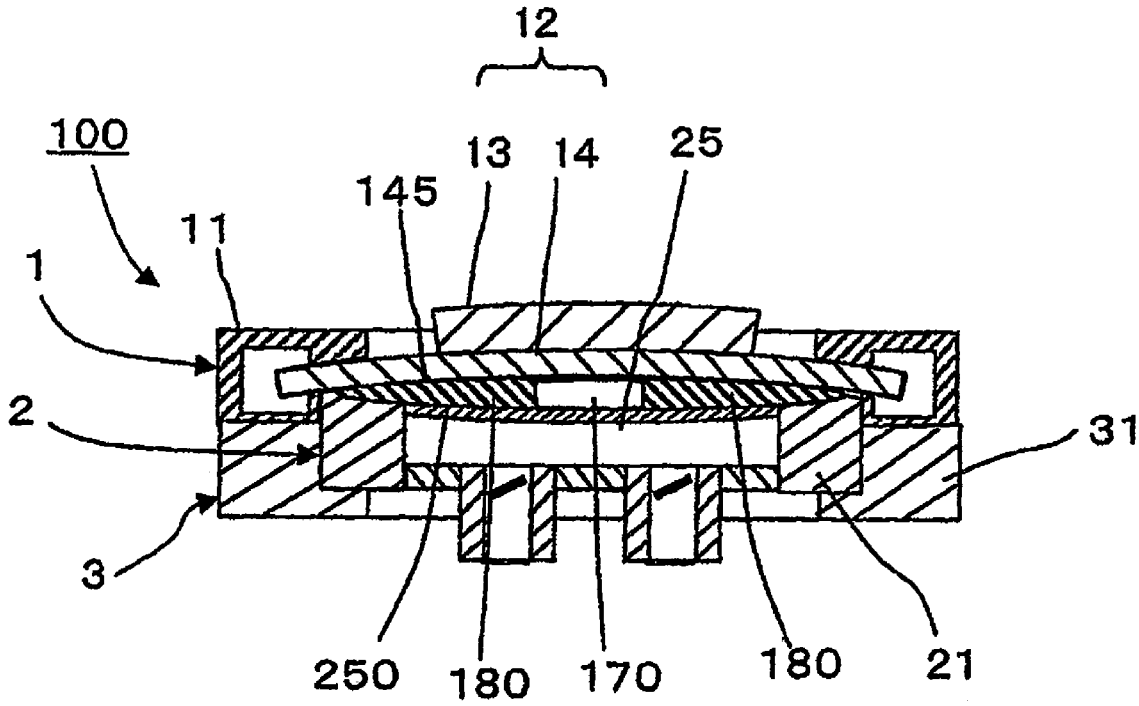
FIG. 16 is a sectional view showing a configuration of a piezoelectric-driven diaphragm pump in accordance with a thirteenth embodiment of the present invention.

Subsequently, a piezoelectric-driven diaphragm pump in accordance with a thirteenth embodiment of the present invention is described with reference to FIG. 16. FIG. 16 shows a configuration of the piezoelectric-driven diaphragm pump P and a displacement transmission member 145 in the thirteenth embodiment.

In the piezoelectric-driven diaphragm pump P in the thirteenth embodiment, an elastic coefficient in a center portion of the displacement transmission member 145 is made larger than that in a peripheral portion. The diaphragm sheet 14 of the driving diaphragm 12 is curved concavely with respect to the reference plane 11*b*, and an NBR film of biconvexity having a thickness of 0.5 mm at the center portion and a thickness of 0.2 mm at the peripheral portion is used as the displacement transmission member 145. In addition, a vulcanization process is performed to the center portion 170 so as to increase the hardening thereof higher than that of the peripheral portion 180.

In the displacement transmission member 145 which is constituted as above, the elastic coefficient in the peripheral portion 180 is smaller than that in the center portion 170, so that the peripheral portion of the displacement transmission member 145 can be transformed easier. Thus, the transformation quantity of the displacement transmission member 145 in the radial direction becomes larger as the transformed portion approaches to the outer periphery thereof. Therefore, it is possible to make the transformation in the center portion 170 smaller but the transformation in the peripheral portion 180 larger, so that a resistance against the transformation of the driving diaphragm 12 due to the displacement transmission member 145 can be reduced. On the other hand, the hardness of the center portion 170 of the displacement transmitting member 145, where the transformation by the displacement of the driving diaphragm 12 becomes the largest, is made higher by the above vulcanization process. Thereby, the elastic coefficient of the center portion 170 becomes larger, and the transformation quantity in the center portion 170 of the displacement transmitting member 145 becomes smaller. Consequently, the transmission efficiency of the transformation of the driving diaphragm 12 in the thickness direction can be made larger, so that the capacity of the pump room 25 of the driven unit 2 can be varied larger.

Fourteenth Embodiment

Figure 17:
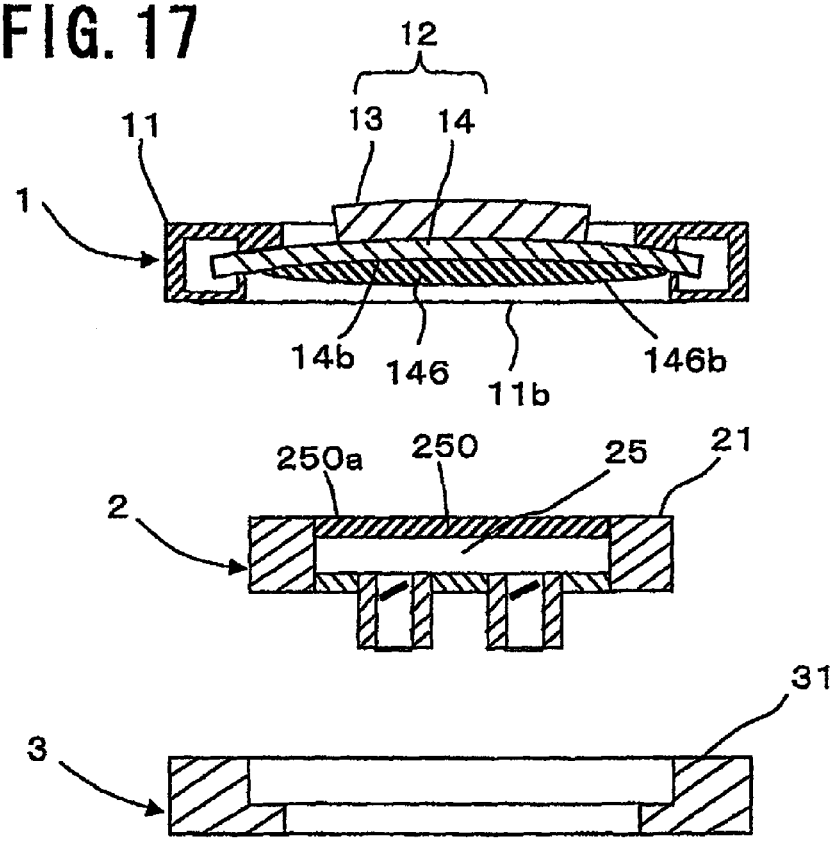
FIG. 17 is an exploded sectional view showing a configuration of a piezoelectric-driven diaphragm pump in accordance with a fourteenth embodiment of the present invention.
Figure 18:
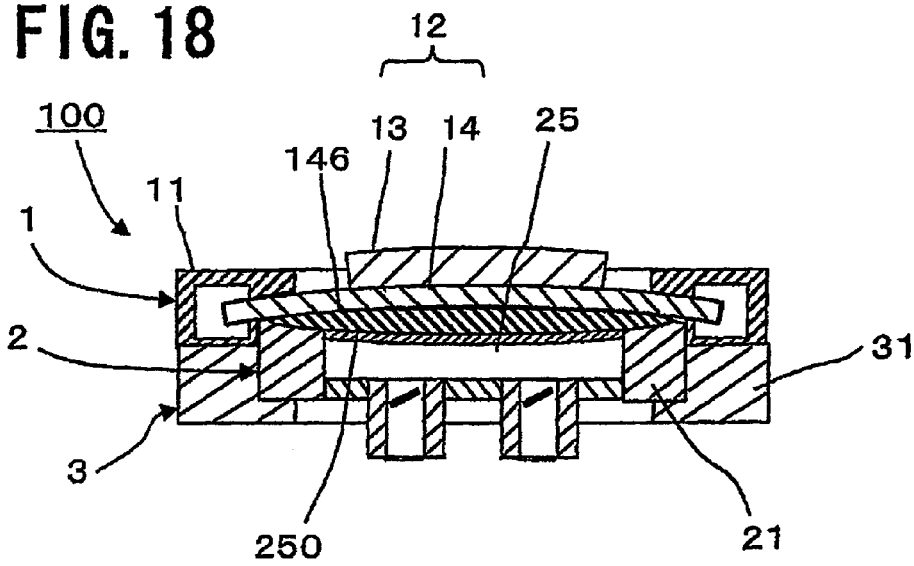
FIG. 18 is a sectional view showing a configuration of the piezoelectric-driven diaphragm pump in the fourteenth embodiment.

Subsequently, a piezoelectric-driven diaphragm pump in accordance with a fourteenth embodiment of the present invention is described with reference to FIGS. 17 and 18. FIG. 17 shows a configuration of the piezoelectric-driven diaphragm pump P when it is disassembled into each of units, and FIG. 18 shows a configuration of the piezoelectric-driven diaphragm pump P when the units shown in FIG. 17 are assembled.

A basic configuration of the piezoelectric-driven diaphragm pump P in accordance with the fourteenth embodiment is similar in the case of the eleventh embodiment shown in FIGS. 12 and 13. However, in the piezoelectric-driven diaphragm pump P in the fourteenth embodiment, it is different that the displacement transmission member 146 is made of an NBR film having a hardness of 60 degrees, and driven film 250 is made of an NBR film having a thickness of 0.2 mm and a hardness of 40 degrees.

When the driven unit 2 is inserted into the first fitting portion 15 of the first housing 11 of the driving unit 1, a center portion of the driven film 250 contacts an outside face 146*b* of the displacement transmission member 146 of the driving diaphragm 12 first, so that the driven film 250 is bent to be convexity with respect to the reference plane 11*b*. When the driven unit 2 is further pushed toward the driving unit 1, a contact area between the driven film 250 and the displacement transmission member 146 is increased. At this time, since the elastic coefficient of the displacement transmission member 146 is larger than that of the driven film 250, transformation caused by the contact of the displacement transmission member 146 and the driven film 250 mainly occurs in the driven film 250 side, and the convexity of the displacement transmission member 146 can be maintained. According to the fourteenth embodiment, since the displacement transmission member 146 is hard to be transformed, transmission efficiency of the vibration of the driving diaphragm 12 to the driven film 250 can be increased.

Fifteenth Embodiment

Figure 19:
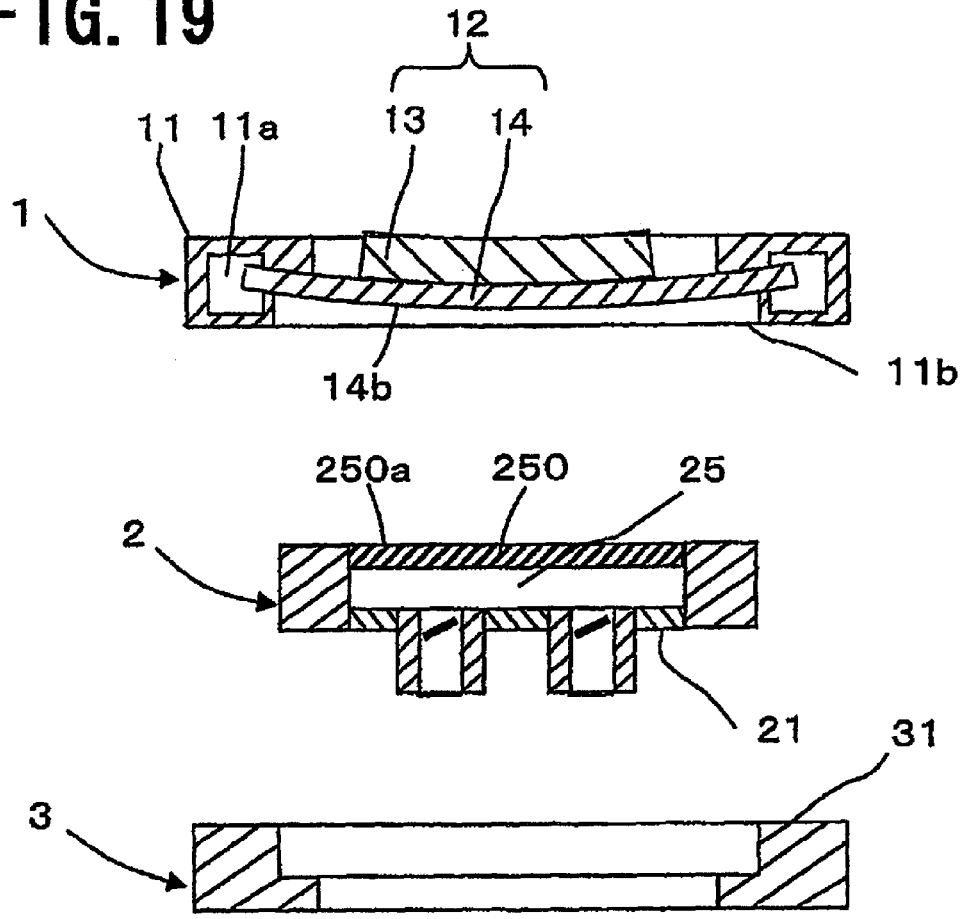
FIG. 19 is an exploded sectional view showing a configuration of a piezoelectric-driven diaphragm pump in accordance with a fifteenth embodiment of the present invention.
Figure 20:
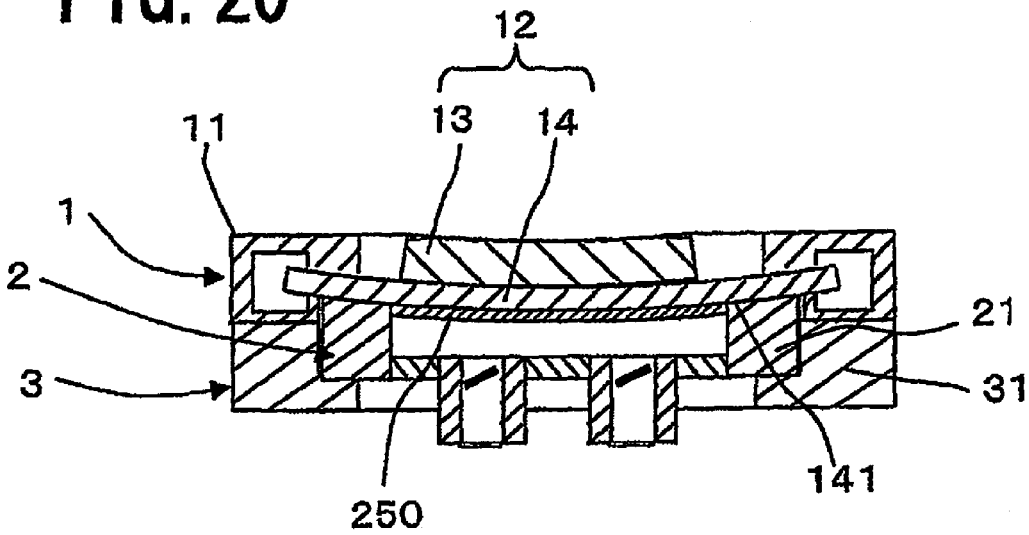
FIG. 20 is a sectional view showing a configuration of the piezoelectric-driven diaphragm pump in the fifteenth embodiment.

Subsequently, a piezoelectric-driven diaphragm pump in accordance with a fifteenth embodiment of the present invention is described with reference to FIGS. 19 and 20. FIG. 19 shows a configuration of the piezoelectric-driven diaphragm pump P when it is disassembled into each of units, and FIG. 20 shows a configuration of the piezoelectric-driven diaphragm pump P when the units shown in FIG. 19 are assembled.

In the piezoelectric-driven diaphragm pump P in the fifteenth embodiment, the diaphragm sheet 14 of the driving diaphragm 12 is bent convexly by about 0.2 mm with reference to the reference plane 11*b*. In this case, the outside face 14*b* of the diaphragm sheet 14 serves as the vibration transmission face of the driving diaphragm 12, and the displacement transmission member is omitted.

When the driven unit 2 is inserted into the first fitting portion 15 of the driving unit 1, since the diaphragm sheet 14 has a convexity with respect to the reference plane 11*b* having a vertex at the center thereof, the center portion of the driven film 250 contacts the center portion of the outside face 14*b* of the diaphragm sheet 14, and the driven film 250 is warped to be concavity with respect to the reference plane 11*b* along the shape of the diaphragm sheet 14. When the driven unit 2 is further pushed toward the driving unit 1, a contact area between the driven film 250 and the diaphragm sheet 14 is increased.

In this way, by forming the shape of the diaphragm sheet 14 of the driving diaphragm 12 as convexity with respect to the reference plane 11*b*, the driven film 250 can be contacted with the outside face 14*b* of the diaphragm sheet 14 smoothly with using no the displacement transmission member. Therefore, the contact of the diaphragm sheet 14 and the driven film 250 can be ensured without occurrence of defect such as air entering in between the outside face 250*a* of the driven film 250 and the outside face 14*b* of the diaphragm sheet 14. Furthermore, since the center portion of the driven film 250 and the center portion of the diaphragm sheet 14 are contacted surely, the displacement in the center portion of the driving diaphragm 12 which is the largest in the thickness direction can be utilized. Thereby, the capacity of the pump room 25 of the driven unit 2 can be varied largely.

Figure 21:
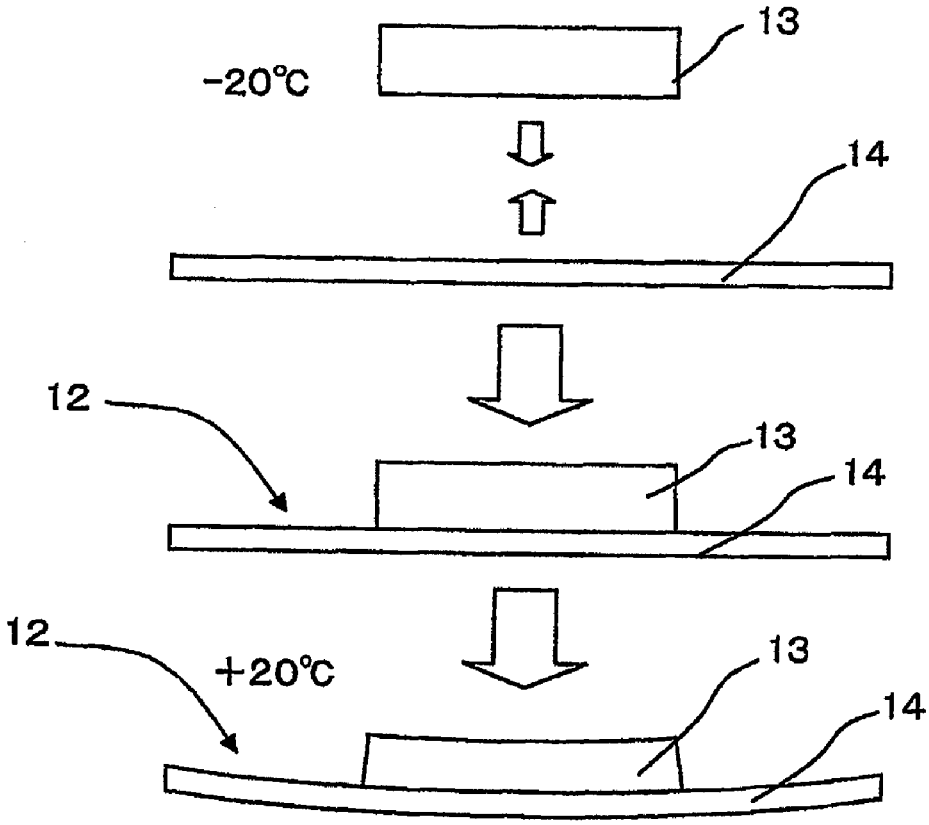
FIG. 21 is a side view showing a manufacturing method of a driving diaphragm in the fifteenth embodiment.
Figure 22:
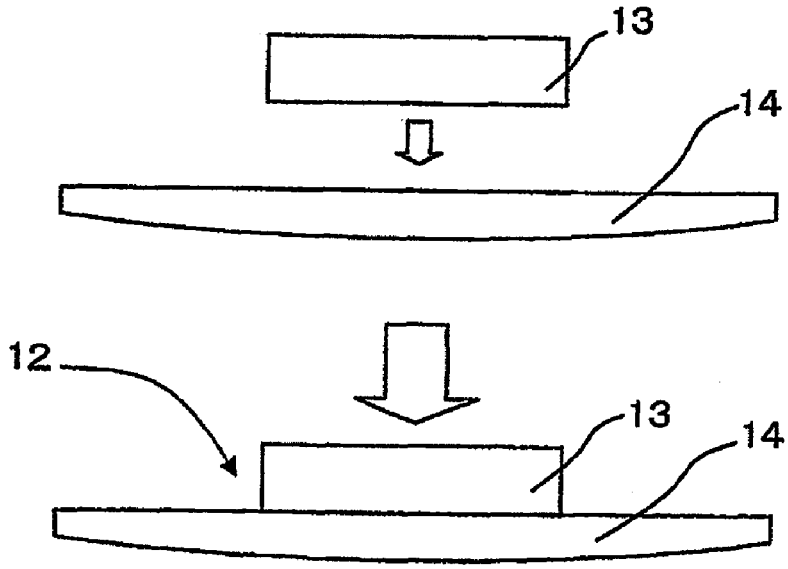
FIG. 22 is a side view showing another manufacturing method of a driving diaphragm in the fifteenth embodiment.

Subsequently, a manufacturing process of the driving diaphragm 12 having the convex diaphragm sheet 14 with respect to the reference plane 11*b* is shown in FIG. 21. For example, the diaphragm sheet 14 and the piezoelectric element 13 which are in a flat state in an environment from 0° C. to −20° C. Celsius are adhered together with using a two-component adhesive. When unified body of the diaphragm sheet 14 and the piezoelectric element 13 is brought back in an environment of 20° C. Celsius (room temperature) after the adhesion of them, the driving diaphragm 12 that the diaphragm sheet 14 is bent as convexity with respect to the reference plane 11*b* can be obtained by a difference between the thermal expansion coefficients of the diaphragm sheet 14 and the piezoelectric element 13. Alternatively, as shown in FIG. 22, the piezoelectric element 13 may be adhered to the diaphragm sheet 14 which is previously formed as convexity in an environment of a room temperature. According to the fifteenth embodiment, the displacement transmission member can be omitted, so that a number of elements constituting the piezoelectric-driven diaphragm pump can be reduced.

Sixteenth Embodiment

Figure 23A:
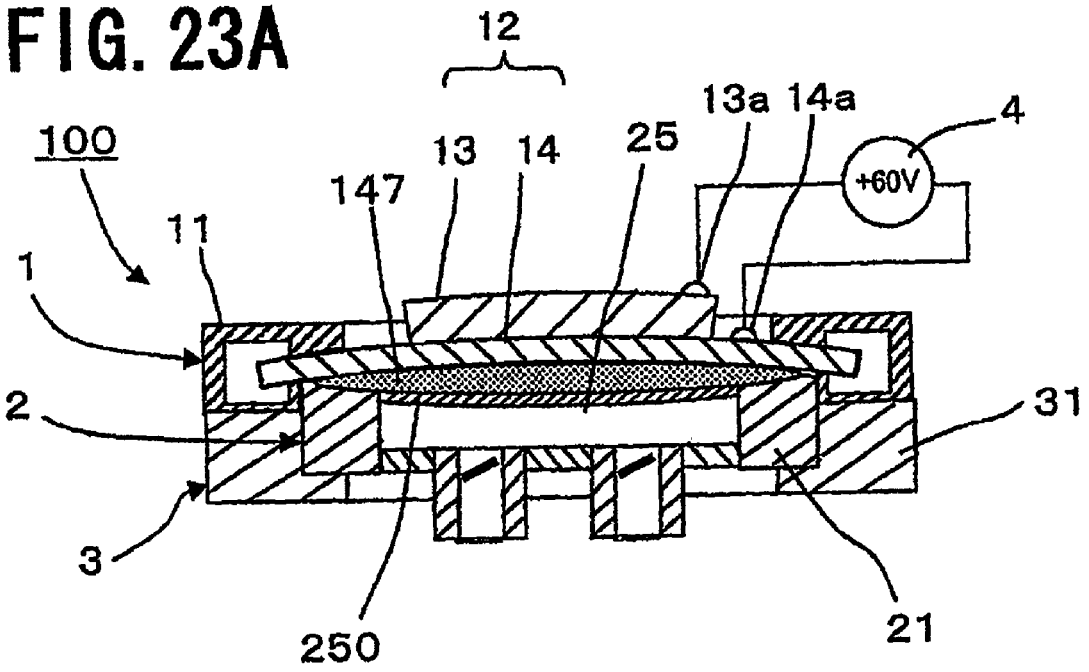
FIG. 23A is a sectional view showing a configuration and discharge motion of the piezoelectric-driven diaphragm pump in the accordance with a sixteenth embodiment of the present invention.
Figure 23B:
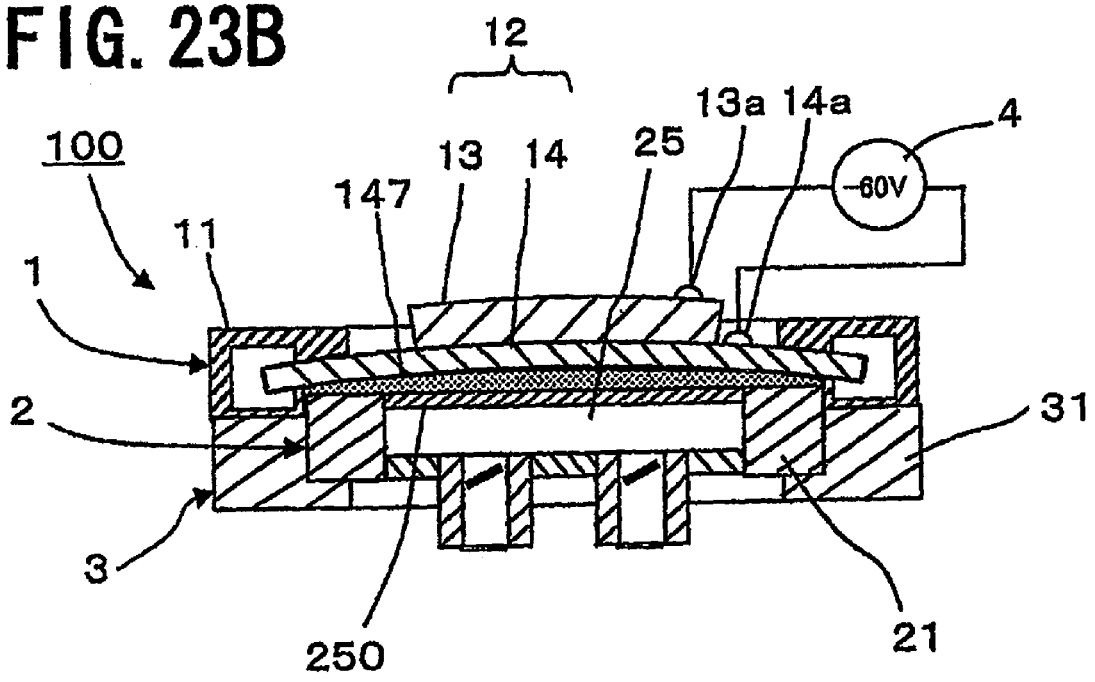
FIG. 23B is a sectional view showing a configuration and suction motion of the piezoelectric-driven diaphragm pump in the sixteenth embodiment.

Subsequently, a piezoelectric-driven diaphragm pump in accordance with a sixteenth embodiment of the present invention is described with reference to FIGS. 23A and 23B. FIG. 23A shows a discharge state of the piezoelectric-driven diaphragm pump P in the sixteenth embodiment, and FIG. 23B shows a suction state of the piezoelectric-driven diaphragm pump P.

In the piezoelectric-driven diaphragm pump P in the sixteenth embodiment, the contacting face of the displacement transmission member 147 with the driven film 250 is curved convexly with respect to the reference plane 11*b* at the maximum transformation of the driving diaphragm 12. The diaphragm sheet 14 of the driving diaphragm 12 is curved concavely with respect to the reference plane 11*b*, and an NBR film of biconvexity having a thickness of 0.5 mm at the center portion and a thickness of 0.2 mm at the peripheral portion is used as the displacement transmission member 147. The displacement transmission member 147 is attached to the diaphragm sheet 14 by adhesive.

It is assumed that an alternating voltage which is varied from +60V to −60V is applied to the piezoelectric element 13 of the driving diaphragm 12. For example, when a voltage of +60V is applied, the piezoelectric element 13 contracts in the radial direction, and thereby, the concaving quantity of the driving diaphragm 12 becomes smaller. The driven film 250 is pushed in the thickness direction by the displacement transmission member 147. Subsequently, when a voltage of −60V is applied, the piezoelectric element 13 expands in the radial direction, and thereby, the concaving quantity of the driving diaphragm 12 becomes larger. Hereupon, by using an object which maintains the convexity when a reverse voltage is applied as the displacement transmission member 147, the displacement transmission member 147 can always contact with and push the driven film 250 in the center portion thereof. Therefore, it is possible to take a displacement similar in the case of driving the piezoelectric element 13 by applying an alternating voltage varied from 0V to +120V. Since the reverse voltage can be utilized in the sixteenth embodiment, an absolute value of the voltage applied to the piezoelectric element 13 can be decreased. Consequently, the power consumption of the piezoelectric-driven diaphragm pump P can be reduced largely. In addition, since the displacement transmission member 147 and the driven film 250 are contacted in entire surfaces of them, the piezoelectric-driven diaphragm pump P can be driven even when the reverse voltage is applied to the piezoelectric element 13 at the driving of the driving diaphragm 12.

Other Modifications

Figure 24:
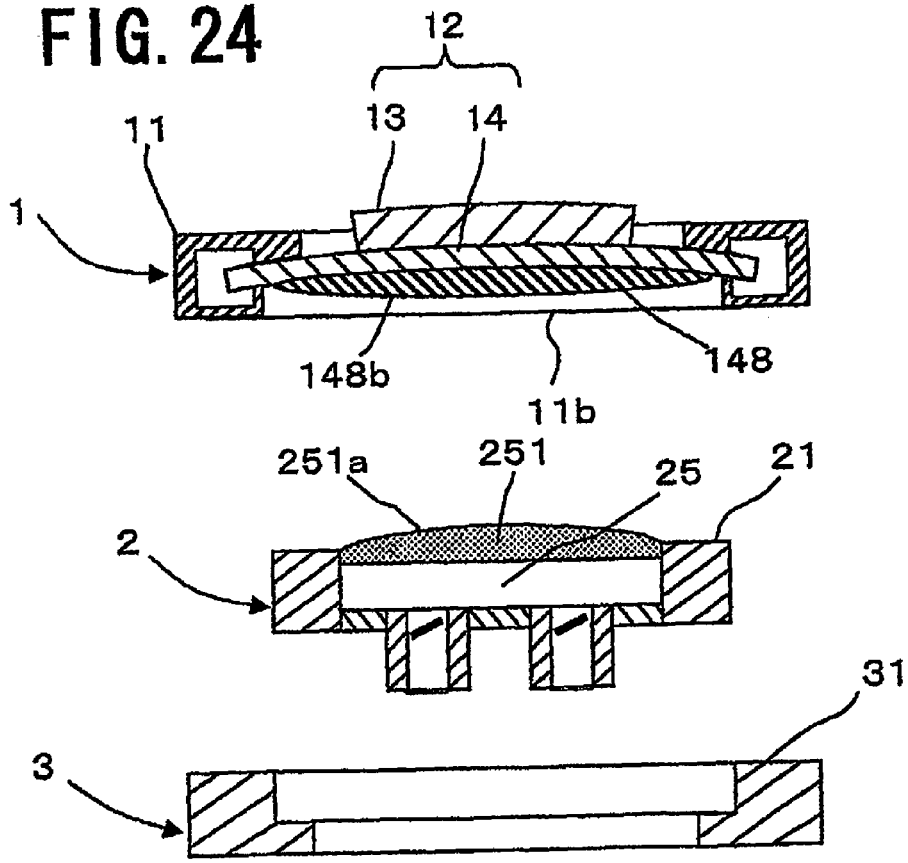
FIG. 24 is an exploded sectional view showing a configuration of a piezoelectric-driven diaphragm pump in accordance with a modification of the present invention.
Figure 25:
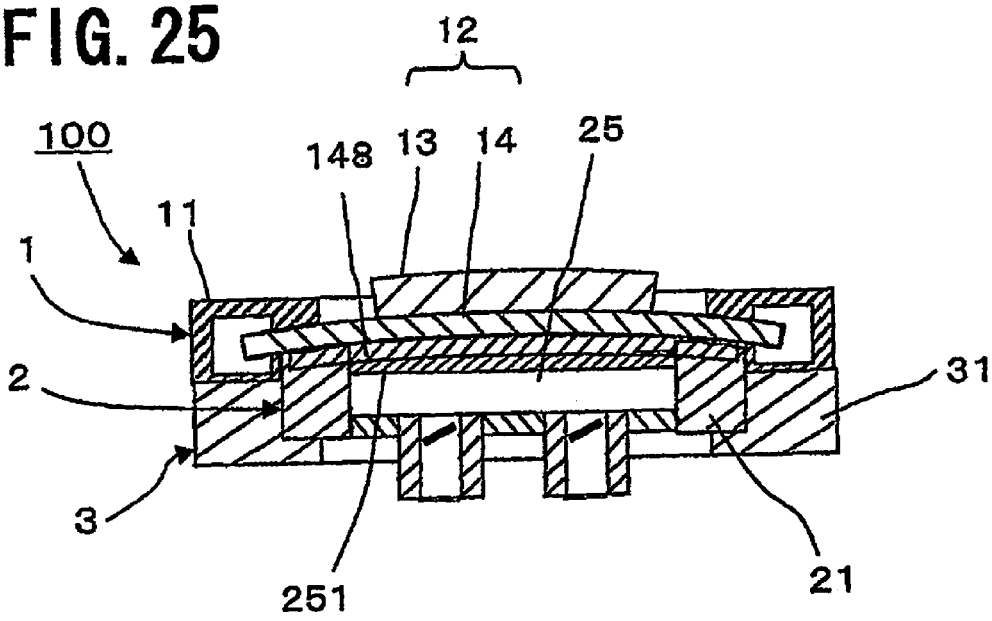
FIG. 25 is a sectional view showing a configuration of the piezoelectric-driven diaphragm pump in the above modification.
Figure 26:
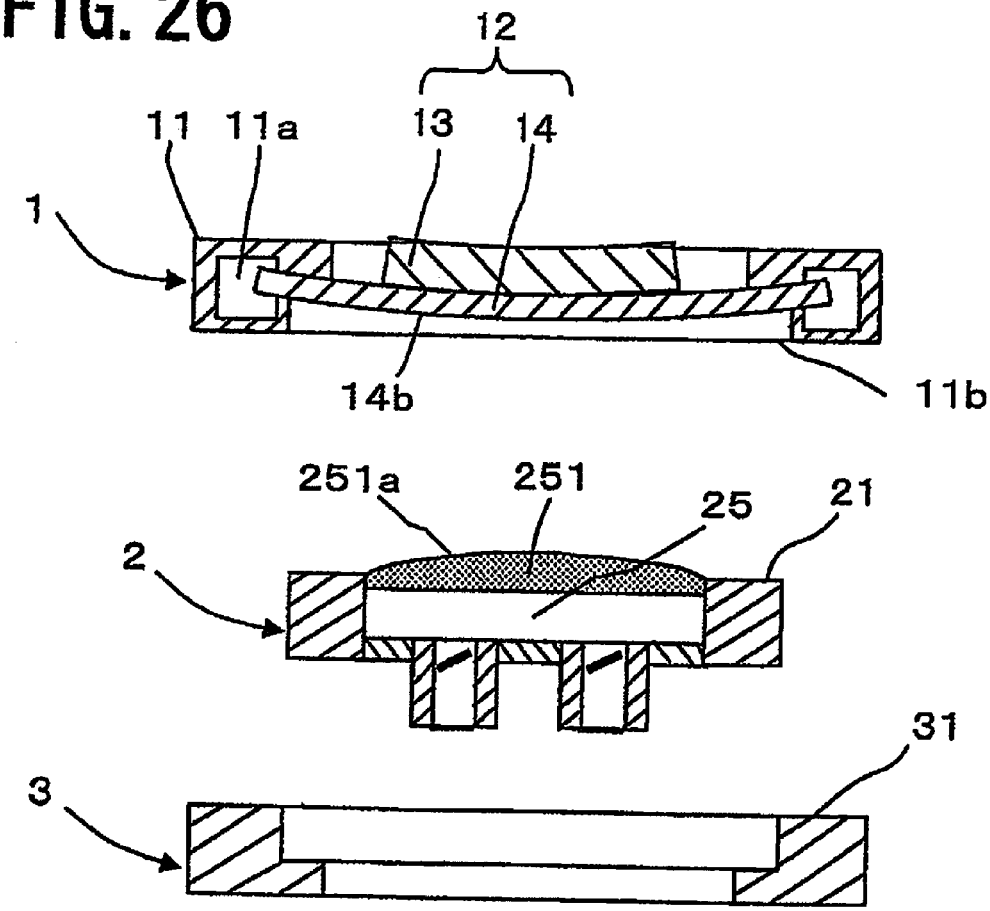
FIG. 26 is an exploded sectional view showing a configuration of a piezoelectric-driven diaphragm pump in accordance with another modification of the present invention.
Figure 27:
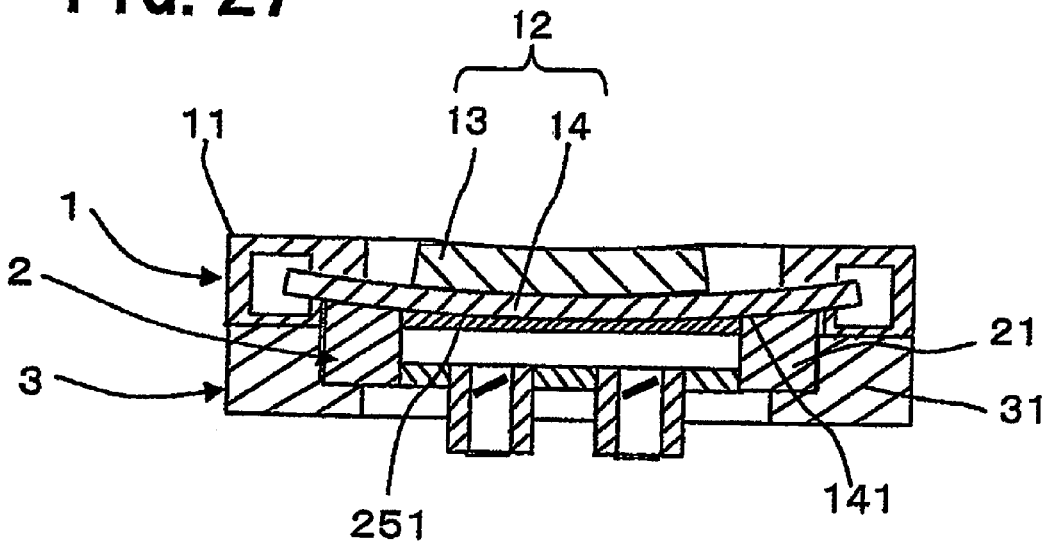
FIG. 27 is a sectional view showing a configuration of the piezoelectric-driven diaphragm pump in the above another modification.
Figure 28:
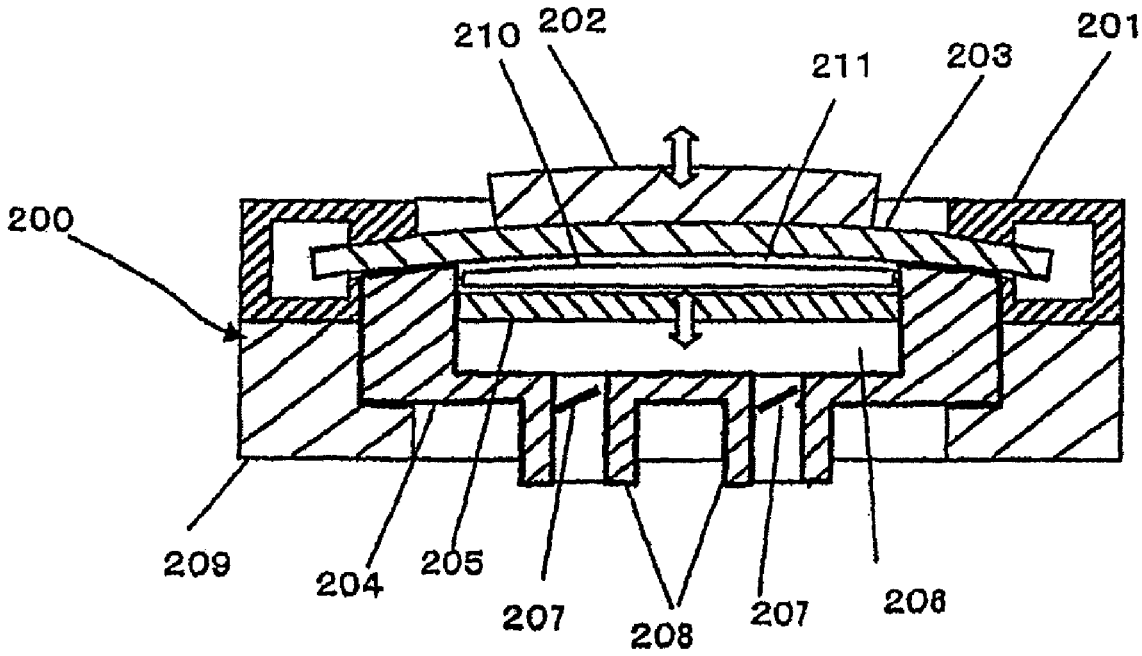
FIG. 28 is a sectional view showing a configuration of a conventional piezoelectric-driven diaphragm pump.

The present invention is not limited to the above-mentioned configuration of the embodiments, and various kinds of modification can be performed in a scope where the subject of the invention is not changed. As shown in FIGS. 24 and 25, it is possible to form both of the outside face 148*b* of the displacement transmission member 148 and the outside face 251*a* of the driven film 251 convex with respect to the reference plane 11*b*. Alternatively, as shown in FIGS. 26 and 27, it is possible to omit the displacement transmission member, and to form both of the outside face 14*b* of the diaphragm sheet 14 and the outside face 251*a* of the driven film 251 convex with respect to the reference plane 11*b*. In other words, in these modifications, the combination of the vibration transmitting face of the driving diaphragm 12 and the vibration transmitted face of the driven film 251 becomes convex and convex. By such configurations, advantageous effect the same as each of the above embodiment can be provided. Furthermore, characteristics of the above embodiments may be put together appropriately.

This application is based on Japanese patent applications 2005-18967 and 2005-127038 filed in Japan, the contents of which are hereby incorporated by references.

Although the present invention has been fully described by way of example with reference to the accompanying view showing configurations, it is to be understood that various changes and modifications will be apparent to those skilled in the art. Therefore, unless otherwise such changes and modifications depart from the scope of the present invention, they should be construed as being included therein.

The invention claimed is:

1. A piezoelectric-driven diaphragm pump, comprising:

a driving unit comprising a driving diaphragm and a first housing that holds the driving diaphragm, the driving diaphragm having a piezoelectric element, a diaphragm sheet which is elastically transformed corresponding to transformation of the piezoelectric element, and a displacement transmission member provided on a face of the diaphragm sheet, a driven unit driven by the driving unit, the driven unit having a driven film to which vibration of the driving diaphragm is transmitted, a second housing for holding the driven film, valves performing open and close motions for sucking and discharging fluid into and from a cavity formed between the second housing and the driven film, and pipe conduits through which the fluid passes;

a fixing unit for detachably fixing the driven unit to the driving unit; and a face of the displacement transmission member facing the driven film defines a vibration transmitting face of the driving diaphragm, and the vibration transmitting face of the driving diaphragm from which displacement of the driving diaphragm is transmitted to the driven film is convex when the driving diaphragm is not driven and a vibration transmitted face of the driven film to which the displacement of the driving diaphragm is transmitted is concave when the driving diaphragm is not driven, and the vibration transmitting face of the driving diaphragm contacts an entirety of the vibration transmitted face of the driven film when the second housing of the driven unit is completely fitted to a fitting portion of the first housing.

2. The piezoelectric-driven diaphragm pump in accordance with claim 1, wherein the face of the diaphragm sheet facing the driven film is concave when the driving diaphragm is not driven.

3. The piezoelectric-driven diaphragm pump in accordance with claim 1, wherein rate of transformation of the displacement transmission member in an in-plane direction is larger than that in a direction perpendicular to the in-plane direction.

4. The piezoelectric-driven diaphragm pump in accordance with claim 1, wherein elastic coefficient in a center portion of the displacement transmission member is larger than that in a peripheral portion thereof.

5. The piezoelectric-driven diaphragm pump in accordance with claim 4, wherein vulcanization process is performed to the center portion of the displacement transmission member, or the center portion of the displacement transmission member is made of a material different from that of the peripheral portion thereof.

6. The piezoelectric-driven diaphragm pump in accordance with claim 1, wherein elastic coefficient of the displacement transmission member is larger than elastic coefficient of the driven film.

7. The piezoelectric-driven diaphragm pump in accordance with claim 1, wherein the displacement transmitting face of the displacement transmission member is convex in a side of the driven film at a maximum transformation thereof.

* * * * *